US008855531B2

(12) United States Patent
Suzuki et al.

(10) Patent No.: US 8,855,531 B2
(45) Date of Patent: Oct. 7, 2014

(54) IMAGE FORMING APPARATUS WITH REMOVABLE CARTRIDGE SUPPORTING MEMBER

(75) Inventors: Kensuke Suzuki, Tagata-gun (JP); Tsutomu Nishiuwatoko, Numazu (JP); Ken Kikuchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 13/472,808

(22) Filed: May 16, 2012

(65) Prior Publication Data

US 2012/0294646 A1 Nov. 22, 2012

(30) Foreign Application Priority Data

May 17, 2011 (JP) ..... 2011-110619

(51) Int. Cl.
*G03G 15/00* (2006.01)
*G03G 21/16* (2006.01)
*G03G 21/18* (2006.01)

(52) U.S. Cl.
CPC ..... *G03G 21/1633* (2013.01); *G03G 21/1853* (2013.01); *G03G 2215/0132* (2013.01); *G03G 2221/1684* (2013.01); *G03G 2221/183* (2013.01)
USPC ..... 399/110

(58) Field of Classification Search
USPC ..... 399/110, 111
See application file for complete search history.

(56) References Cited

U.S. PATENT DOCUMENTS 7,761,025 B2 7/2010 Sato
7,778,567 B2 8/2010 Igarashi et al.
7,813,670 B2 10/2010 Matsuda
8,045,887 B2 10/2011 Sakashita et al.
8,185,013 B2 5/2012 Kikuchi et al.
8,213,825 B2 7/2012 Sato
2006/0067734 A1 3/2006 Igarashi et al.
2007/0166070 A1 7/2007 Sato
2008/0028967 A1 2/2008 Sakashita et al.
2009/0190955 A1 7/2009 Igarashi et al.

(Continued)

FOREIGN PATENT DOCUMENTS

JP 10-26863 A 1/1998
JP 2001-66968 A 3/2001

(Continued)

OTHER PUBLICATIONS

International Search Report mailed Nov. 22, 2011, in International Application No. PCT/JP2011/068720.

*Primary Examiner* — Quana M Grainger
(74) *Attorney, Agent, or Firm* — Fitzpatrick, Cella, Harper & Scinto

(57) ABSTRACT

An image forming apparatus for forming an image on a recording material includes a cartridge supporting member carrying a first cartridge and a second cartridge. The cartridge supporting member includes a first guide portion for guiding mounting and demounting of the first cartridge relative to a first mounting portion, and a second guide portion for guiding mounting and demounting of the second cartridge relative to a second mounting portion. When the second cartridge is dismounted from the second mounting portion, the second cartridge moves in a downstream direction with respect to a drawing direction, and wherein a distance of movement, in the downstream direction, of the second cartridge along the second guide portion from the second mounting portion until the second cartridge is dismounted is greater than a distance of movement, in the downstream direction, of the first cartridge along the first guide portion from the first mounting portion until the first cartridge is dismounted.

20 Claims, 19 Drawing Sheets

(56) References Cited

U.S. PATENT DOCUMENTS

| | | | |
|---|---|---|---|
| 2010/0239308 | A1 | 9/2010 | Kikuchi et al. |
| 2010/0239312 | A1 | 9/2010 | Kikuchi et al. |
| 2010/0247138 | A1 | 9/2010 | Kikuchi et al. |
| 2010/0247140 | A1 | 9/2010 | Kikuchi et al. |
| 2010/0247142 | A1 | 9/2010 | Kikuchi et al. |
| 2011/0002709 | A1 | 1/2011 | Sato |
| 2011/0305479 | A1 | 12/2011 | Nishiuwatoko et al. |
| 2012/0003005 | A1 | 1/2012 | Nishiuwatoko |
| 2012/0195627 | A1 | 8/2012 | Kikuchi |

FOREIGN PATENT DOCUMENTS

| | | | |
|---|---|---|---|
| JP | 2002-72826 | A | 3/2002 |
| JP | 2002-207408 | A | 7/2002 |
| JP | 2006-98772 | A | 4/2006 |
| JP | 2007-193125 | A | 8/2007 |
| JP | 2007-213012 | A | 8/2007 |
| JP | 2007-333817 | A | 12/2007 |

IMAGE FORMING APPARATUS WITH REMOVABLE CARTRIDGE SUPPORTING MEMBER

FIELD OF THE INVENTION AND RELATED ART

The present invention relates to an image forming apparatus which forms an image on recording medium, and in which multiple cartridges are removably installable in its main assembly.

An image forming apparatus to which the present invention relates includes an apparatus which forms a color image on recording medium with the use of an electrophotographic image formation process, for example. Examples of an electrophotographic color image forming apparatus include an electrophotographic color copy machine, an electrophotographic color printer (color laser beam printer, color LED printer, etc., for example), a color facsimile machine, a color word processor, etc.

"Recording medium" means medium on which an image is formed by an image forming apparatus. It includes paper, OHP sheet, and the like.

A "cartridge" to which the present invention is related means a process cartridge or a development cartridge. It contributes to the process for forming an image on recording medium while remaining removably mounted in the main assembly of the image forming apparatus. Here, a "process cartridge" means a cartridge which integrally holds no less than one processing means among a charging means, a developing means, and a cleaning means, and an electrophotographic photosensitive drum, and is removably installable in the main assembly of an image forming apparatus. In other words, a "process cartridge" includes: a cartridge in which a developing means (processing means) and an electrophotographic photosensitive drum are integrally held, and which is removably installable in the main assembly of an image forming apparatus; a cartridge in which a charging means (processing means), a developing means (processing means) or cleaning means (processing means), and an electrophotographic photosensitive drum are integrally held, and which is removably installable in the main assembly of an image forming apparatus. Incidentally, a process cartridge in which an electrophotographic photosensitive drum and a developing means are held is referred to as a process cartridge of the integration type, whereas a process cartridge in which an electrophotographic drum and a process cartridge or process cartridges other than a developing means are integrally held is referred to as a process cartridge of the separation type. That is, a process cartridge which does not include a developing means, and therefore, has to be used in combination with a development unit (developing means cartridge) in order to form an image, is referred to as a process cartridge of the separation type.

A process cartridge is removably installable in the main assembly of an image forming apparatus by a user himself or herself. Therefore, it can make it easier to maintain the main assembly of an image forming apparatus. "Processing means" is such means that processes an electrophotographic photosensitive drum.

A development cartridge has a development roller. It contains developer (toner) which is used by the development roller to develop an electrostatic latent image formed on an electrophotographic photosensitive drum. It is removably installable in the main assembly of an image forming apparatus. In the case of an image forming apparatus which uses a development cartridge, its electrophotographic photosensitive drum is attached to the main assembly of the apparatus, or a process cartridge of the separation type (which does not have developing means). A development cartridge also can be removably installable in the main assembly of an image forming apparatus by a user himself or herself. Therefore, it can make it easier to maintain the main assembly of an image forming apparatus.

That is, a "cartridge" includes both a cartridge of the integration type and a cartridge of the separation type. A process cartridge of the separation type is used in combination with a development cartridge. In the case of an image forming apparatus, the electrophotographic photosensitive drum of which is attached to its main assembly or cartridge supporting member (which will be described later), a development cartridge has to be removably installed in the main assembly of the image forming apparatus before it can be used for processing the electrophotographic photosensitive drum. Further, a "cartridge" related to the present invention includes such a developer cartridge that stores developer (toner) which is to be supplied to the aforementioned process cartridge or development cartridge.

As described above, there has been known an electrophotographic image forming apparatus which forms an image on recording medium with the use of an electrophotographic image formation process. It has also been known that an electrophotographic image forming apparatus uses a process cartridge system, or a development cartridge system (which does not include photosensitive drum and has development unit). Further, it has been known that an electrophotographic image forming apparatus uses a developer cartridge system which stores developer. The process cartridge system, development cartridge system, and developer cartridge system together are referred to simply as a "cartridge system".

The above-described process cartridge and development cartridge have a developer storage in which the developer (toner) for developing the above described electrostatic latent image is stored.

On the other hand, in order to make it easier for a user to replace a cartridge in the main assembly of an image forming apparatus, some image forming apparatuses are provided with a cartridge drawer (cartridge supporting member) in which multiple cartridges are supportable. These image forming apparatuses are structured so that the drawer is movable between its preset position in their main assembly (inside position), and its preset position outside their main assembly (outside position). Thus, when it is necessary to replace any of the cartridges in the drawer, the drawer can be pulled out of their main assembly to the preset outside position where the cartridges can be replaced (Japanese Laid-open Patent Application 2007-213012).

The above-described structural arrangement, however, suffers from the following technological problem. That is, even when the cartridge drawer is in the outside position (as far out of the main assembly of the image forming apparatus as possible), the cartridges in the upstream side of the drawer are close to the main assembly. Therefore, there is a substantial distance between these cartridges and a user, since the user has to replace the cartridges from the downstream end of the drawer.

SUMMARY OF THE INVENTION

Thus, the primary object of the present invention is to provide an image forming apparatus which employs a cartridge drawer capable of holding multiple cartridges, and is significantly superior in operability in terms of the operation for installing a cartridge into the upstream side of the cartridge drawer, in terms of the direction in which the drawer is pulled out of the main assembly of the apparatus, or removing a cartridge from the upstream side of the cartridge drawer, than any image forming apparatus in accordance with the prior art.

According to an aspect of the present invention, there is provided an image forming apparatus for forming an image on a recording material, said image forming apparatus comprising a cartridge supporting member movable between an inside position in which said cartridge supporting member is inside a main assembly of said image forming apparatus in a state of carrying a first cartridge and a second cartridge, and a drawn position in which said cartridge supporting member is outside said main assembly of said apparatus and in which said first cartridge and said second cartridge are mountable and demountable relative to said cartridge supporting member, wherein said cartridge supporting member includes a first mounting portion to which said first cartridge is mountable, and a second mounting portion to which said second cartridge is mountable, said second mounting portion being disposed upstream of said first mounting portion with respect to a drawing direction in which said cartridge supporting member is moved from the inside position to the drawn position; a first guide portion, provided on said cartridge supporting member, for guiding mounting and demounting of said first cartridge relative to said first mounting portion; and a second guide portion, provided on said cartridge supporting member, for guiding mounting and demounting of said second cartridge relative to said second mounting portion, wherein a downward movement distance of said second cartridge when said second cartridge is demounted from said second mounting portion is larger than a downward movement distance of said first cartridge when said first cartridge is demounted from said first mounting portion.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 2(*b*) is an enlargement of a part of FIG. 2(*a*).

FIG. 2(*b*) is an enlargement of a part of FIG. 12(*a*).

DESCRIPTION OF THE PREFERRED EMBODIMENTS

Hereinafter, the embodiments of the present invention are described in detail with reference to the appended drawings. However, the measurement, material, and shape of the structural components in the following embodiments of the present invention, and the positional relationship among the structural components, are not intended to limit the present invention in scope in terms of these aspects of an image forming apparatus.

Embodiment 1

Overall Structure of Electrophotographic Color Image Forming Apparatus

Figure 1:
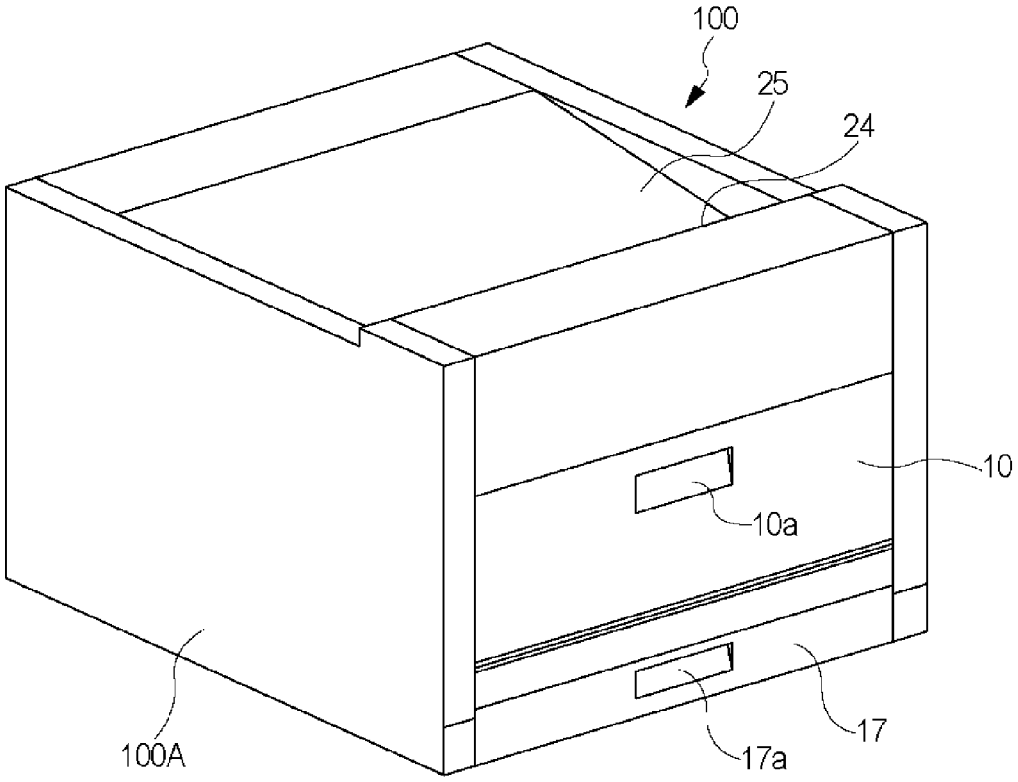
FIG. 1 is an external perspective view of the image forming apparatus 100 in the first embodiment of the present invention.
Figure 2:
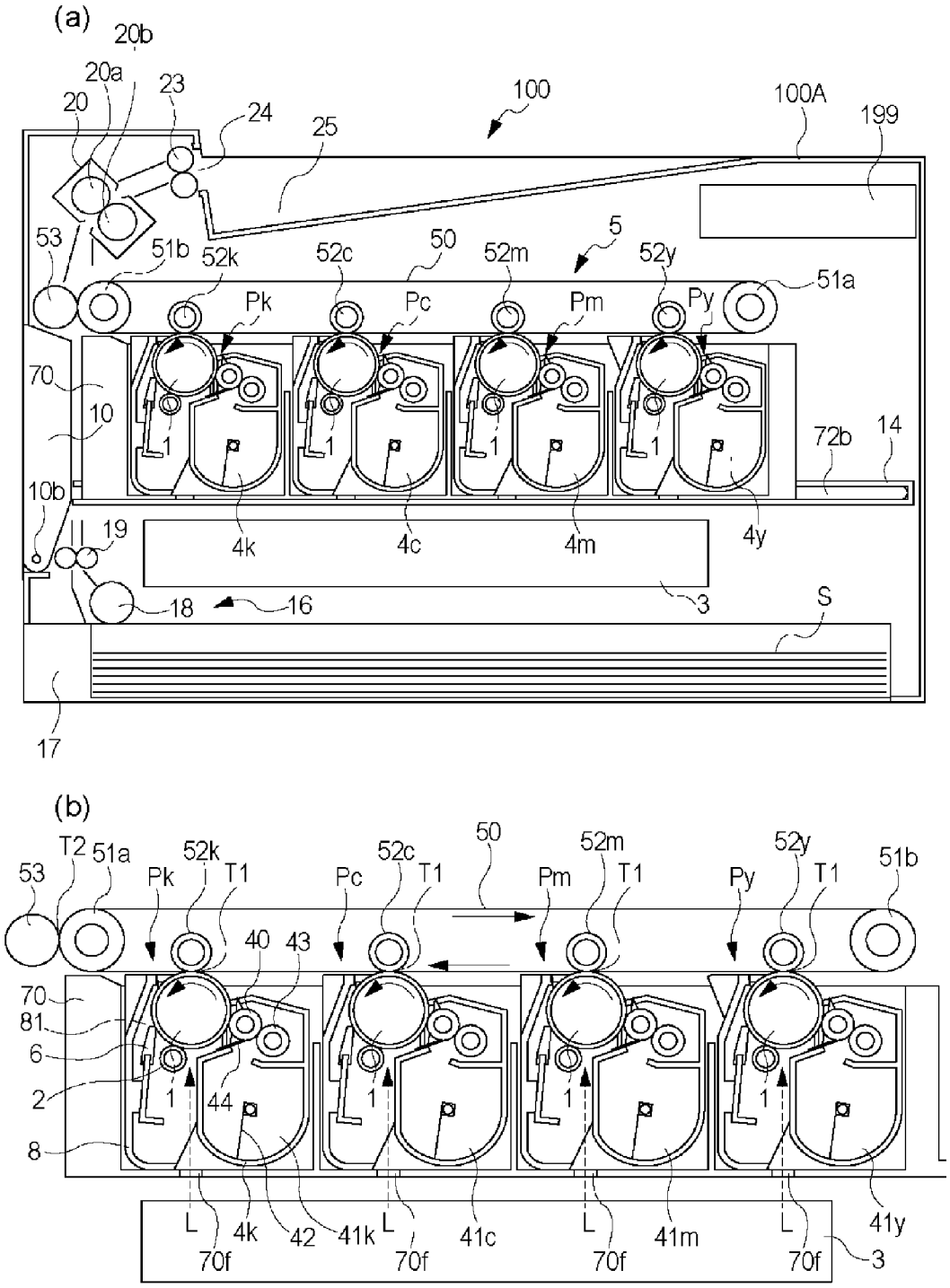
FIG. 2(*a*) is a vertical schematic sectional view of the image forming apparatus 100 at a vertical plane perpendicular to the front panel of the apparatus 100, as seen from the right-hand side of the apparatus 100. It shows the general structure of the apparatus 100.

FIG. 1 is an external perspective view of the image forming apparatus 100 (which hereafter may be referred to simply as image forming apparatus) in the first embodiment of the present invention. FIG. 2(*a*) is a vertical schematic sectional view of the image forming apparatus 100 at a vertical plane perpendicular to the front panel of the apparatus 100, as seen from the right-hand side of the apparatus 100. FIG. 2(*b*) is an enlargement of a part of FIG. 2(*a*). The image forming apparatus 100 is a full-color laser printer based on four primary colors. It uses an electrophotographic process. It forms a full-color image on a sheet S of recording medium, based on the electrical image formation signals inputted from a host apparatus (unshown), such as a personal computer, an image reader, a facsimile machine (on transmitting side), etc.

In the following description of the embodiments of the present invention, the front or front side of the image forming apparatus 100 is the side of the image forming apparatus 100, which has a door 10 which covers the cartridge drawer. The rear side of the image forming apparatus 100 is the opposite side from the front side of the apparatus 100. The front-to-rear direction means both the frontward and rearward directions. The left and right sides of the image forming apparatus 100 mean the left and right sides as seen from the front side of the apparatus 100. The left-right direction means both the leftward and rightward directions. The main assembly 100A of the image forming apparatus 100 means what remains after the removal of the cartridges from the image forming apparatus 100.

The image forming apparatus 100 in this embodiment is of the so-called horizontal tandem type. It employs four process cartridge P (Py, Pm, Pc and Pk) which form yellow (y), magenta (m), cyan (c) and black (k) developer (toner) images, respectively. The four process cartridges P are horizontally aligned in tandem. The image forming apparatus 100 is structured so that the multiple cartridges P are removably installable in its main assembly 100A. It forms a color image on a sheet S of recording medium.

More concretely, there are four process cartridges P (Py, Pm, Pc and Pk) in the apparatus main assembly 100A. Listing from the rear side of the apparatus main assembly 100A, the first to fourth process cartridges Py, Pm, Pc and Pk are roughly horizontally aligned. Each process cartridge P (which hereafter may be referred to simply as cartridge P) has an electrophotographic photosensitive drum 1 (which hereafter is referred to simply as drum 1), on which an electrostatic latent image is formed. Referring to FIG. 2, the drum 1 is rotated in the counterclockwise direction (indicated by arrow mark) in FIG. 2(*b*). Each process cartridge P has also a charging mean 2, a developing means 4 (4*y*, 4*m*, 4*c* or 4*k*), and a drum cleaning means 6, which are means for processing the drum 1. The drum processing means are in the adjacencies of the peripheral surface of the drum 1, being arranged in the listed order in terms of the rotational direction of the drum 1.

This embodiment is described with reference to the aforementioned process cartridge of the so-called integration type. However, it is not intended to limit the present invention in terms of the process cartridge type.

The drum 1 is made up of an aluminum cylinder, and an organic photoconductive layer formed on the peripheral surface of the aluminum cylinder by coating the peripheral surface of the aluminum cylinder with an organic photosensitive substance.

The charging means 2 (processing means) uses a charge roller (electrically conductive roller). It uses one of the contact charging methods. The charge roller 2 is roughly parallel to the drum 1, and is in contact with the peripheral surface of the drum 1. It is rotated by the rotation of the drum 1. As a preset charge bias (charge voltage) is applied to the charge roller 2 from an electric power source (unshown), the peripheral surface of the drum 1 is uniformly charged by the charge roller 2 to a preset polarity and a preset potential level.

The developing means 4 (processing means) is in the form of a development unit 4. It develops an electrostatic latent image on the peripheral surface of the drum 1 with the use of developer (toner). The development units 4 (4*y*, 4*m*, 4*c* and 4*k*), which the cartridges P (Py, Pm, Pc and Pk, respectively) have, have developer storages 41 (41*y*, 41*m*, 41*c* and 41*k*, respectively), which store developers T (Ty, Tm, Tc and Tk, respectively). They have also a development roller 40 for developing an electrostatic latent image on the drum 1. Further, they have: a developer conveyance member 42 which conveys the developer T in the developer storage 41; a developer supply roller 43 which coats the development roller 40 with the developer; and a development blade 44 which is a developer regulating member and is kept pressed upon the peripheral surface of the development roller 40.

The drum cleaning means 6 (processing means) is the means for removing the developer remaining on the peripheral surface of the drum 1 after the transfer (primary transfer) of a developer image on the peripheral surface of the drum 1 onto a transfer belt 50. The cleaning means 6 in this embodiment employs a cleaning blade as a cleaning member. The developer removed from the peripheral surface of the drum 1 is stored in the storage 8 for the removed developer.

Each cartridge P is made up of a photosensitive member unit 8 and a development unit 4 (4*y*, 4*m*, 4*c* and 4*k*) which are in connection to each other. The photosensitive member unit 8 has the aforementioned drum 1, charge roller 2, and drum cleaning unit 6. Each cartridge P is removably installable in the apparatus main assembly 100A; it is removably installable in a cartridge drawer which can be moved into, or out of, the apparatus main assembly 100A. The details of the structure of the cartridge P, and the details of the structure of the cartridge drawer, are described later.

The cartridge Py stores yellow (y) developer Ty in the developer storage 41*y* of its developer unit 4*y*. It forms a yellow developer image on the peripheral surface of the drum 1. The cartridge Pm stores magenta (m) developer Tm in the developer storage 41*m* of its developer unit 4*m*. It forms a magenta developer image on the peripheral surface of the drum 1. The cartridge Pc stores cyan (c) developer Tc in the developer storage 41*c* of its developer unit 4*c*. It forms a cyan developer image on the peripheral surface of the drum 1. The cartridge Pk stores black (k) developer Tk in the developer storage 41*k* of its developer unit 4*y*. It forms a black developer image on the peripheral surface of the drum 1.

The apparatus main assembly 100A has a laser scanner unit 3, which is under the space into which the cartridges P (Py, Pm, Pc and Pk) are installed. It has also a transfer unit 5, which is on the top side of the space for the cartridges.

The scanner unit 3 is made up of a laser diode, a polygon mirror, an F-θ lens, a deflection mirror, etc. It scans (exposes) the uniformly charged area of the peripheral surface of the drum 1, by emitting a beam L of laser light while modulating the beam L with the information of the monochromatic image of each of the primary colors (of which image is to be formed) inputted into a control circuit 199 from a host apparatus. As a result, an electrostatic latent image, which reflects the pattern of exposure, is formed on the peripheral surface of the drum 1.

The transfer unit 5 has an intermediary transfer belt 50 (endless belt), which is dielectric and flexible. It has also the first and second belt suspension rollers 51*a* and 51*b*, by which the intermediary transfer belt 50 is suspended and kept stretched. Further, the transfer unit 5 has four primary transfer rollers 52 (52*y*, 52*m*, 52*c* and 52*k*), which are inside the loop which the intermediary transfer belt 50 forms. In terms of the moving direction of the intermediary transfer belt 50, the primary transfer rollers 52 are between the first and second belt suspension rollers 51*a* and 51*b*. They are kept pressed against the drum 1 of the corresponding cartridge P with the presence of the intermediary transfer belt 50 between themselves and drums 1, one for one. The area of contact between the drum 1 of each cartridge P and intermediary transfer belt 50 is the primary transfer nip T1. Further, the transfer unit 5 has a secondary transfer roller 53, which is kept pressed against the belt suspension roller 51*b* with the presence of the intermediary transfer belt 50 between itself and the belt suspension roller 51*b*. The area of contact between the secondary transfer roller 53 and intermediary transfer belt 50 is the secondary transfer nip T2.

The operation for forming a full-color image is as follows: The four cartridges P are sequentially driven with preset control timing. That is, each drum 1 is rotationally driven in the counterclockwise direction (indicated by arrow mark in FIG. 2). The transfer belt 50 of the belt unit 5 is also driven, along with the scanner unit 3. In synchronism with the driving of these components, the charge roller 2 in each cartridge P uniformly charges the peripheral surface of the drum 1 to a preset polarity and a preset potential level. The scanner unit 3 scans (exposes) the uniformly charged area of the peripheral surface of the drum 1 with a beam of laser light which it emits while modulating the beam with image formation signals. As a result, an electrostatic latent image, which reflects the image formation signals, is formed on the peripheral surface of the drum 1. Then, the electrostatic latent image is developed by the development unit 4 (4*y*, 4*m*, 4*c* or 4*k*) (development roller 40) into a developer image, that is, an image formed of developer.

Through an electrophotographic process such as the one described above, a monochromatic yellow developer image, which corresponds to the yellow component of the full-color image, is formed on the drum 1 of the cartridge Py. On the drum 1 of the cartridge Pm, a monochromatic magenta developer image, which corresponds to the magenta component of the full-color image is formed. On the drum 1 of the cartridge Pc, a monochromatic cyan developer image, which corresponds to the magenta component of the full-color image is formed. Further, on the drum 1 of the cartridge Pk, a monochromatic black developer image, which corresponds to the black component of the full-color image is formed. These monochromatic developer images are electrostatically and sequentially transferred in layers (primary transfer) onto the circularly moving intermediary transfer belt 50 in the primary transfer nips T1, one for one. As a result, an unfixed full-color developer image is effected by the layered four monochromatic developer images, that is, yellow, magenta, cyan and black monochromatic developer images on the intermediary transfer belt 50.

Meanwhile, a recording medium conveyance roller 18 of a recording medium feeder section 16 begins to be rotated with a preset control timing, whereby one of the sheets S of recording medium in a recording medium cassette 17 is fed into the apparatus main assembly 100A while being separated from the rest. The cassette 17 is removably installable in the apparatus main assembly 100A from the front side of the apparatus main assembly 100A (front loading). Designated by a referential code 17*a* is a hand-hold, with which the front panel of the recording medium cassette 17 is provided. After being fed into the apparatus main assembly 100A, the sheet S of recording medium is introduced into the secondary transfer nip T2 by a pair of registration rollers 19 with a preset timing. To the transfer roller 53, a preset transfer bias, which is opposite in polarity from the intrinsic polarity of the developer (intrinsic polarity of toner) and has a preset level of potential, is applied from an electric power source (unshown). Thus, yellow, magenta, cyan and black developer images are transferred in layers (secondary transfer) onto the sheet S of recording medium. That is, an unfixed full-color developer image is effected on the sheet S of recording medium.

Next, the sheet S of recording medium is moved out of the secondary transfer nip T2, and is introduced into a fixation section 20, which is a section for fixing the multiple monochromatic developer images, different in color, in the sheet S to the sheet S. The fixation section 20 has: a rotatable heat roller 20*a*; and a rotatable pressure roller 20*b* which is kept pressed upon the heat roller 20*a* to apply heat and pressure to the sheet S and the developer images thereon. After the formation of an unfixed full-color developer image on the sheet S, the sheet S is conveyed through the fixation section 20 while remaining pinched between the pair of fixation rollers 20*a* and 20*b*, and being given heat and pressure by the pair of fixation rollers 20*a* and 20*b*. Consequently, the multiple developer images, different in color, are fixed to the surface of the sheet S of recording medium. Then, the sheet S is conveyed out of the fixation section 20 is conveyed further through a recording medium conveyance passage which includes a pair of discharge rollers 23, and is discharged as a full-color print into an external delivery tray 25 of the apparatus main assembly 100A through a print outlet 24. In this embodiment, the toner remaining on the surface of the intermediary transfer belt 50 after the separation of the sheet S from the belt 50 is electrostatically adhered to the peripheral surface of the drum 1 in the primary transfer nip T1 of the first cartridge 50*y*, for example, and then, is removed by the drum cleaning unit 6.

Incidentally, when the image forming apparatus 100 is in the black-and-white mode, only the cartridge Pk is used for image formation.

(Cartridge Replacement Method)

The image forming apparatus 100 and cartridge P in this embodiment are structured so that as any of the cartridges P in the apparatus main assembly 100A reaches the end of its service life due to the consumption of the developer therein, it can be replaced by a user. The image forming apparatus 100 is provided with a cartridge drawer 70 (as cartridge supporting member), which can be pulled out frontward from the apparatus main assembly 100A to access the cartridges P in the drawer 70. That is, when it is necessary to install a cartridge P into the apparatus main assembly 100A or removing a cartridge P from the apparatus main assembly 100A, the cartridge drawer 70 is to be pulled out of the apparatus main assembly 100A so that the cartridge P can be installed into the drawer 70 or removed from the drawer 70. Then, after the installation of a cartridge P into the drawer 70 or the removal of a cartridge P from the drawer 70, the drawer 70 is to be put back into the apparatus main assembly 100A. This is how the cartridge P can be placed in its specific position in the apparatus main assembly 100A.

Figure 3:
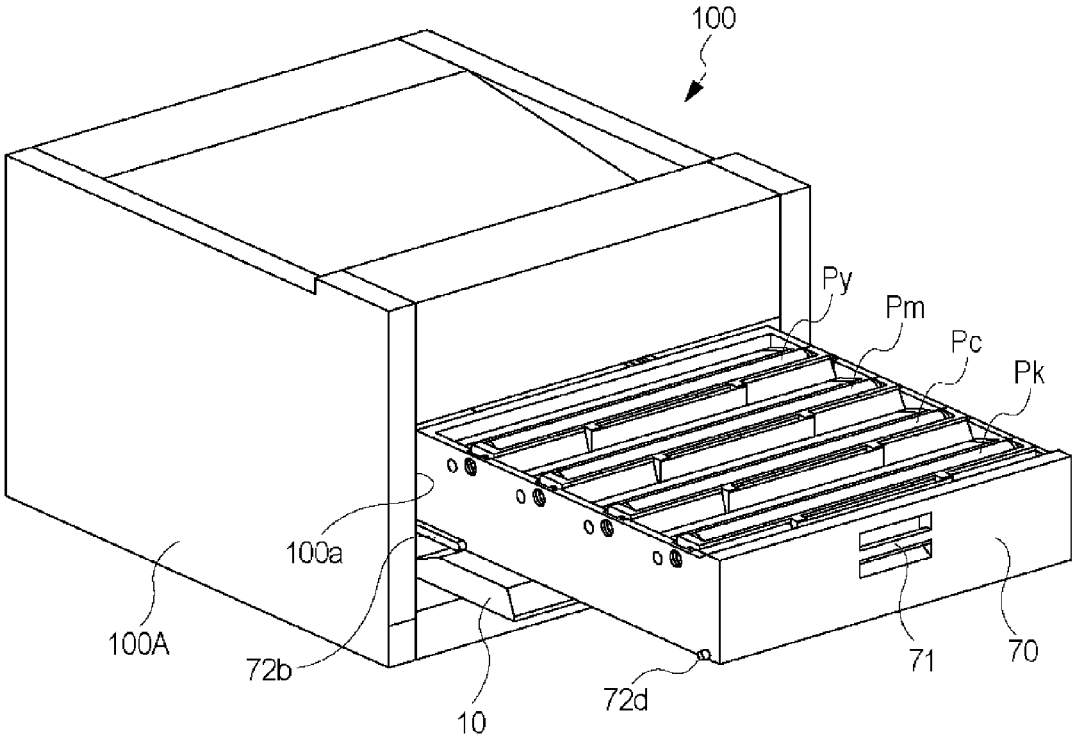
FIG. 3 is a perspective view of the image forming apparatus 100, the cartridge drawer of which is in its preset outside position.
Figure 4:
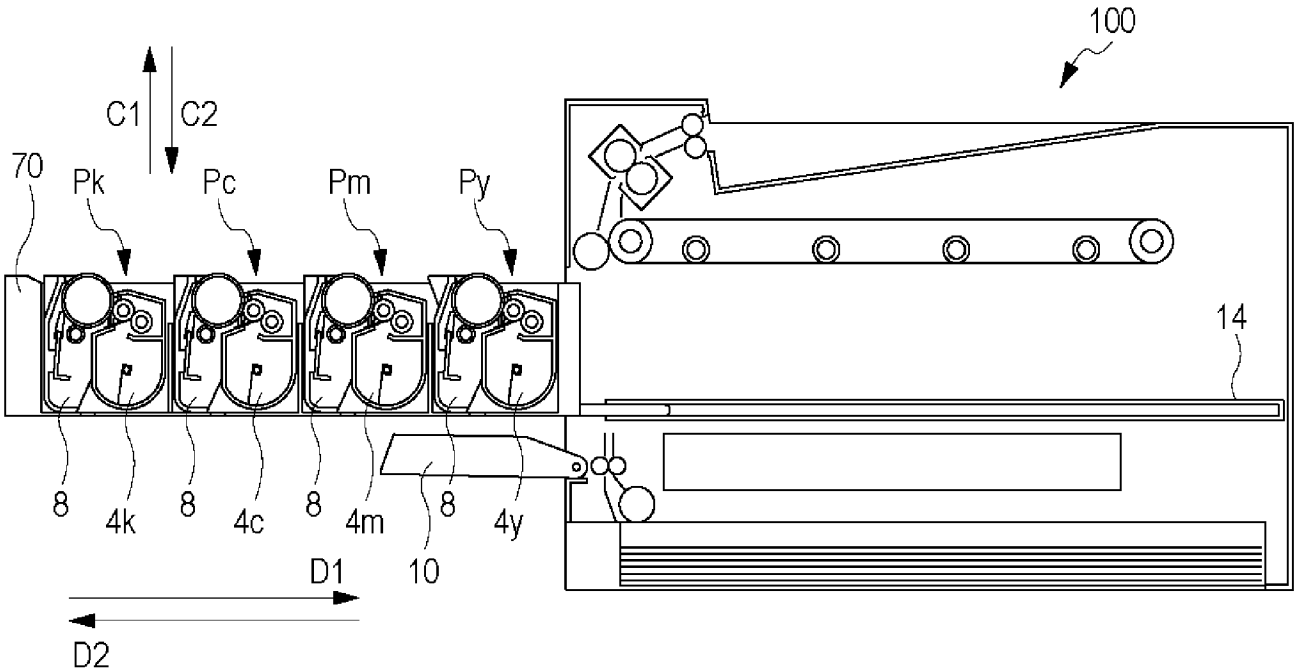
FIG. 4 is a schematic vertical sectional view of the image forming apparatus 100 at a vertical plane perpendicular to the front panel of the apparatus 100, as seen from the right-hand side of the apparatus 100, when the cartridge drawer of the apparatus 100 is in its preset outside position.

The front panel of the apparatus main assembly 100A is provided with an opening 100*a*, through which the cartridge drawer (cartridge supporting member) is pushed into, or pulled out of, the apparatus main assembly 100A, in order to install the cartridge P into the apparatus main assembly 100A, or remove the cartridge P from the apparatus main assembly 100A. Further, the front panel of the apparatus main assembly 100A is provided with a door, which is rotatably movable about a hinge 10*b* (which is at the bottom of the door 10) between a position in which it keeps the opening 100*a* covered, and a position in which it keeps the opening 100*a* exposed. That is, the door 10 is rotatable upward about the hinge 10*b* so that it becomes vertical to cover the opening 100*a* as shown in FIGS. 1 and FIG. 2(*a*), or downward about the hinge 10*b* so that is becomes horizontal to keep the opening 100*a* exposed as shown in FIGS. 3 and 4. Designated by a referential code 10*a* is the aforementioned hand-hold with which the front side of the door 10*a* is provided.

When the door 10 is open, the cartridge drawer 70 can be pulled out of the apparatus main assembly 100A through the opening 10*a*, while being guided by a guiding means 14, as shown in FIGS. 3 and 4. That is, the apparatus main assembly 100A and drawer 70 are structured so that the drawer 70 is practically horizontally movable relative to the apparatus main assembly 100A in the direction indicated by an arrow mark D1 (rearward; direction in which drawer is to be put back into apparatus main assembly 100A), or direction indicated by D2 (outward direction (frontward) in which drawer 70 is pulled to be moved out of apparatus main assembly 100A), which is opposite to the direction D1. The cartridge drawer 70 is provided with four cartridge slots so that it can support four cartridges P. It is structured so that each cartridge P is supported in its designated slot. The four cartridge slots are aligned in tandem (parallel to axial line of drum 1 and axial line of development roller 40) in the direction parallel to the moving direction of the drawer 70 (same direction as directions indicated by arrow marks D1 or D2). That is, the cartridge drawer 70 supports multiple (four) cartridges P (Py, Pm, Pc and Pk) so that the cartridges P are aligned in tandem in the moving direction of the drawer 70 so that the lengthwise direction of each cartridge P is parallel to the axial line of the drum 1 and the axial line of the development roller 40. Further, when the door 10 is open, the cartridge drawer 70 is movable between an inside position A where the entirety of drawer 70 is in the apparatus main assembly 100A, and an outside position B where the cartridges P can be installed into the drawer 70 or removed from the drawer 70. FIG. 2 shows the state of the image forming apparatus 100 when the drawer 70 is in the inside position A. FIGS. 3 and 4 show the state of the image forming apparatus 100 when the drawer 70 is in the outside position B.

When the door 10 is closed (FIGS. 1 and 2), the cartridge drawer 70 is in the inside position A, which is the latent image formation position (image formation position) where the cartridges P in the drawer 70 can form an electrostatic latent image on the drum 1. Further, when the cartridge drawer 70 is in the inside position A, the drum 1 of each cartridge P in the drawer 70 is in contact with the transfer belt 50, and therefore, a developer image on the drum 1 can be transferred (primary transfer) onto the transfer belt 50. Further, when the cartridge drawer 70 is in the inside position A, each cartridge P in the drawer 70 is under the pressure from a cartridge pressing member, being thereby firmly held in a preset position. Also when the cartridge drawer 70 is in the inside position A, the driving force input sections (couplers 47 and 48 in FIG. 8) of each cartridge P are in connection to the driving force output sections (unshown) of the apparatus main assembly 100A, and the electrical contacts (unshown) of each cartridge P are in connection to the electrical power supply system (unshown) of the apparatus main assembly 100A. Also when the cartridge drawer 70 is in its inside position A, it is held to the apparatus main assembly 100A by a drawer positioning means (unshown) so that it cannot move relative to the apparatus main assembly 100A. It is when the image forming apparatus 100 is in the above-described state that the image forming apparatus 100 can form an image.

As the door 10 is opened as shown in FIGS. 3 and 4, the opening 100*a* of the apparatus main assembly 100A is exposed. Thus, the hand-hold of the front panel of the cartridge drawer 70 is exposed through the opening 100*a*. Further, the belt unit 5 is moved upward to a preset position by a linkage (unshown), which is driven by the rotational movement of the door 10. As a result, the transfer belt 11 is separated from the drum 1 of each cartridge P. That is, the drum 1 is separated from the belt 11. Further, each of the driving force outputting portions of the apparatus main assembly 100A becomes disconnected from the corresponding driving force input portion of the cartridge P (driving force removal). Further, the pressure applied by the cartridge pressing member to keep each cartridge P immovably held in the preset position is removed (pressure removal). Further, the power supply system of the apparatus main assembly 100A is disconnected from the electrical contacts of each of the cartridges P (power supply disconnection). Further, the cartridge drawer 70 is released from the drawer positioning means which keeps drawer 70 immovably positioned relative to the apparatus main assembly 100A.

Then, a user is to grasp the hand-hold 71 of the cartridge drawer 70 and horizontally slide the drawer 70 frontward (outward), that is, in the direction D2, as far as the aforementioned outside position B through the opening 100*a*. As the drawer 70 is pulled out to the outside position B, it is prevented by a stopper (unshown) from being pulled out further. While the drawer 70 is moved, the drum 1 in each cartridge P in the drawer 70 remains separated from the transfer belt 50. Therefore, there is no friction between the drum 1 and belt 50.

The cartridge drawer 70 is structured so that each cartridge P (Py, Pm, Pc or Pk) can be pulled out upward from the drawer 70, independently from the others, or can be inserted downward into the drawer 70 to be supported by the drawer 70, independently from the other. In other words, a user is allowed to lift (upward in direction indicated by arrow mark C1 in FIG. 4) only a cartridge P to be replaced, that is, a cartridge whose service life has expired, out of the drawer 70, and lower a brand-new cartridge into the cartridge slot vacated by the used-up cartridge P, from above, virtually in the gravity direction (indicated by arrow mark C2 in FIG. 4), so that the brand-new cartridge P is supported by the drawer 70.

After the replacement of the cartridge or cartridges in the cartridge drawer 70, a user is to horizontally slide the drawer 70 back into the apparatus main assembly 100A in the direction D1 (opposite direction from direction D2) as far as it can be slid, that is, until the drawer 70 is stopped by the stopper (unshown). While the drawer 70 is pushed back into the apparatus main assembly 100A, the drum 1 of each cartridge in the drawer 70 remains separated from the transfer belt 50. Therefore, there is no friction between the drum 1 and belt 50.

After pushing the cartridge drawer 70 into the apparatus main assembly 100A as far as it can be, a user is to close the door 10 so that the opening 100*a* of the apparatus main assembly 100A is covered by the door 10. As the door 10 is closed, the drawer 70 is immovably positioned relative to the apparatus main assembly 100A by the drawer positioning means, which is moved by the closing movement of the door 10 through the aforementioned linkage. Each cartridge P in the drawer 70 is firmly positioned by the cartridge pressing member (unshown). Further, the driving force output portion of the apparatus main assembly 100A becomes connected to the driving force input portion of each cartridge P, and the electric power supply system of the apparatus main assembly 100A becomes electrically connected to the electrical contacts of each cartridge P. Then, the transfer unit 5 lowers to the preset position, whereby the transfer belt 50 is placed in contact with the top portion of the peripheral surface of the drum 1 of each cartridge P. In this embodiment, it is when the image forming apparatus 100 is in the above described state that the image forming apparatus 100 is ready for an image forming operation.

As described above, the multiple (four) cartridges P enter the apparatus main assembly 100A with the cartridge drawer 70 while remaining supported by the drawer 70. Thus, a user is to close the door 10 after pushing the drawer 70 all the way into the apparatus main assembly 100A. Therefore, it is ensured that each of the multiple (four) process cartridges P is precisely positioned relative to the apparatus main assembly 100A. Thus, the structural arrangement, in this embodiment, for an electrostatic image forming apparatus is superior in operational efficiency in terms of cartridge installation and removal than any of conventional structural arrangements for an electrophotographic image forming apparatus, which requires a user to place each cartridge P in the apparatus main assembly 100A independently from the others.

(Cartridge Drawer)

Figure 5:
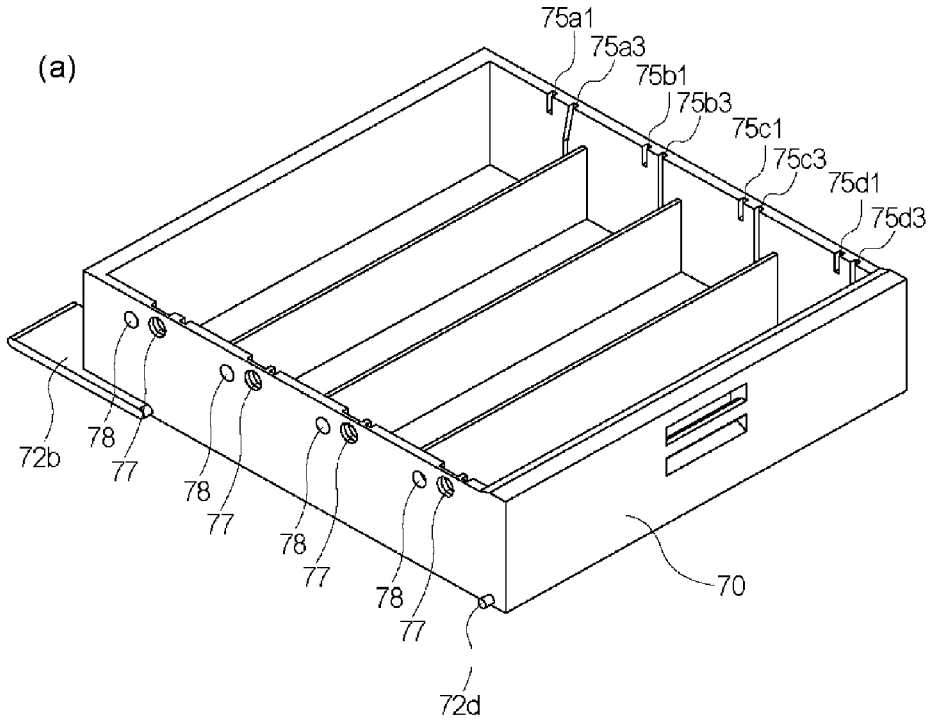
FIGS. 5(*a*) and 5(*b*) are perspective views of the cartridge drawer of the image forming apparatus 100, as seen from the top-left and top-right sides, respectively, of the drawer.
Figure 5:
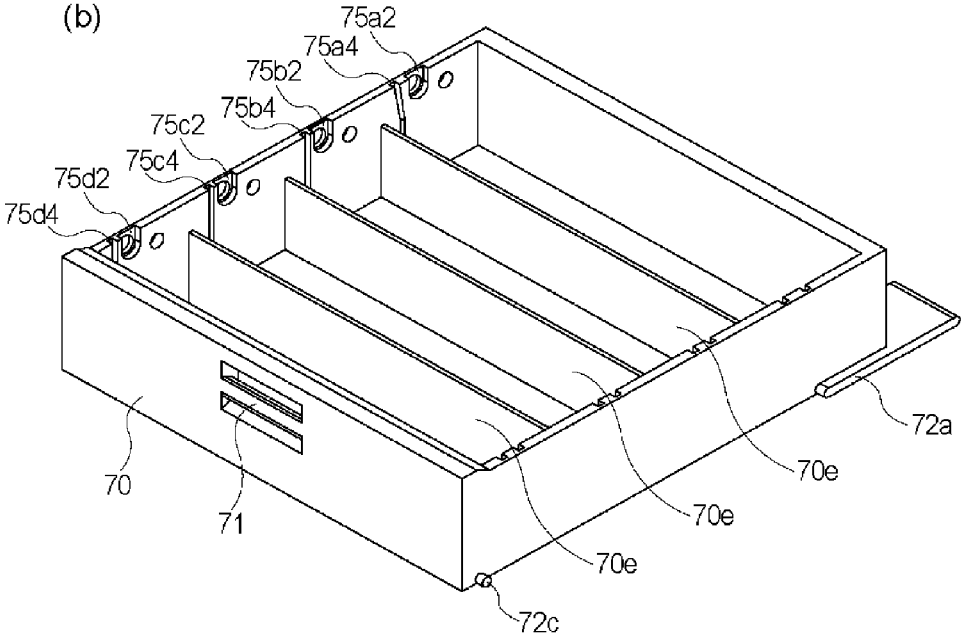
Figure 6:
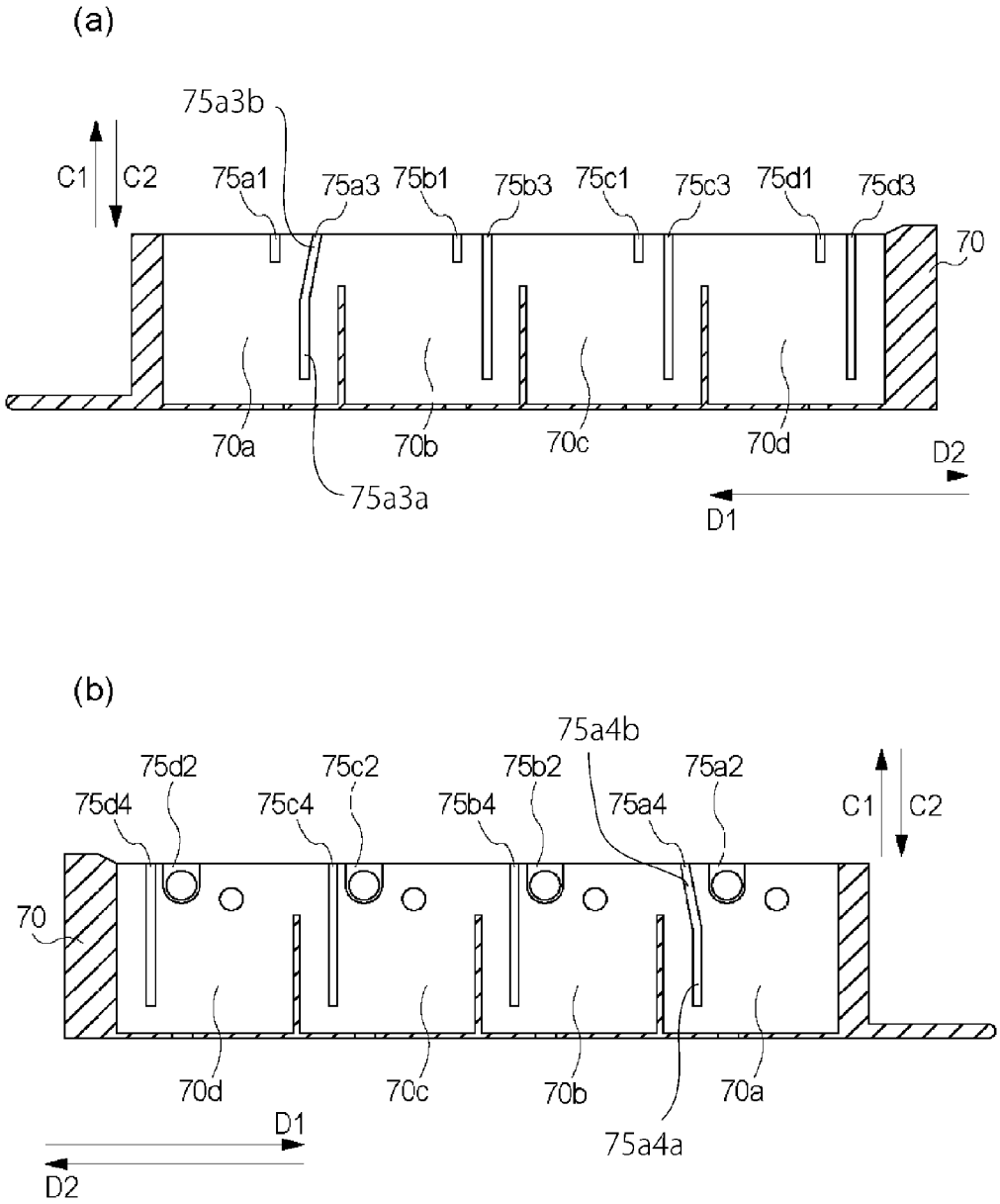
FIGS. 6(*a*) and 6(*b*) are schematic vertical sectional views of the cartridge drawer in the first embodiment, at a vertical plane parallel to the moving direction of the drawer, as seen from the left and right sides, respectively of the apparatus 100.
Figure 7:
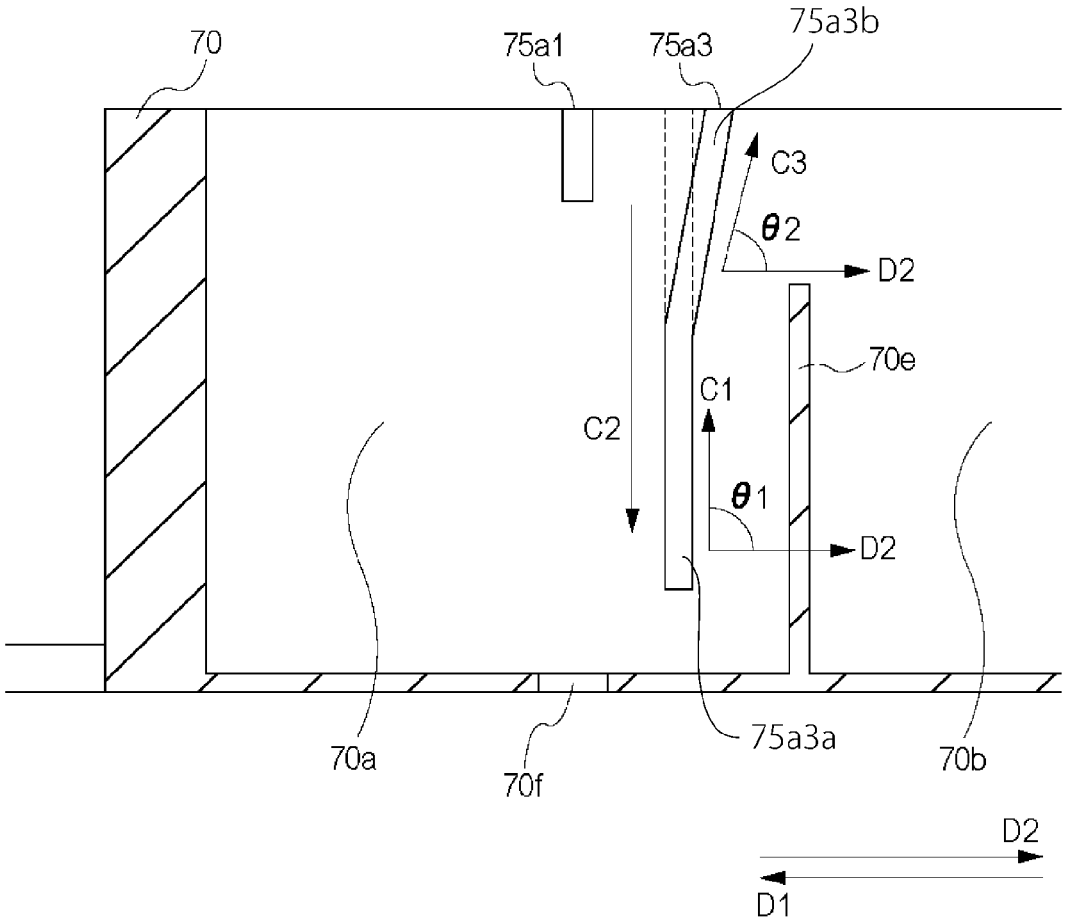
FIG. 7 is an enlarged schematic sectional view of the frontmost cartridge slot, and its adjacencies, of the cartridge drawer in the first embodiment.

Next, referring to FIGS. 5 to 7, the cartridge drawer 70 (cartridge supporting member) is described. FIGS. 5(*a*) and 5(*b*) are perspective views of the cartridge drawer 70, as seen from the top-left and top-right sides, respectively, of the drawer 70. FIGS. 6(*a*) and 6(*b*) are schematic vertical sectional views of the cartridge drawer 70, at a vertical plane parallel to the moving direction of the drawer, as seen from the left and right sides, respectively of the apparatus 100. FIG. 7 is an enlarged schematic sectional view of the frontmost cartridge slot 70*a*, and its adjacencies, in FIG. 6(*a*). The drawer 70 is provided with four drawer guiding portions 72*a*-72*d*, by which the drawer 70 is guided by the left and right drawer guiding means 14 of the apparatus main assembly 100A, and which are at the four corners of the bottom wall of the drawer 70, one for one. The drawer guiding portions 72*a* and 72*c* are in engagement with the drawer guiding means on the right-hand side of the apparatus main assembly 100A, and are guided by the drawer guiding means on the right-hand side of the apparatus main assembly 100A. The drawer guiding portions 72*b* and 72*d* are in engagement with the drawer guiding means on the left-hand side of the apparatus main assembly 100A, and are guided by the drawer guiding means on the left-hand side of the apparatus main assembly 100A.

The drawer guiding portions 72*a* and 72*b*, which are on the upstream side of the drawer guiding portions 72*c* and 72*d* in terms of the direction D2 (in which drawer 70 is pulled out of apparatus main assembly 100A), prevent the drawer 70 from tilting relative to the apparatus main assembly 100A when the drawer 70 is in the outside position B. That is, referring to FIG. 5, the drawing guiding portions 72*a* and 72*b* extend upstream beyond the cartridge slot 70*a* (cartridge supporting slot) which is the most upstream cartridge slot in terms of the direction D2 (outward direction). Each of the drawer guiding portions 72*c* and 72*d* is a cylindrical projection, and projects outward from the corresponding lateral wall of the drawer 70, perpendicular to the direction D2 (outward direction), at the downstream end of the drawer 70.

The front side of the front panel of the cartridge drawer 70 is provided with the hand-hold 71, which is to be used by a user to move the drawer 70.

The cartridge drawer 70 is provided with four cartridge slots 70*a*-70*d* (which will be described later), which are aligned in tandem in the front-rear direction. In terms of the direction D (direction of outward movement of drawer 70), the first cartridge slot 70*a*, which is for the cartridge Py, is the most upstream slot of the drawer 70. The other three cartridge slots 70*b*, 70*c* and 70*d* for the cartridges Pm, Pc and Pk, respectively, are on the downstream side of the cartridge slot 70*a*, in the listed order. There is a partition wall 70*e* between the adjacent two cartridge slots, functioning as a marker for assisting a user when the user inserts a cartridge P into a specific slot in the drawer 70. The bottom wall of each cartridge slot is provided with an opening 70*f*, through which the beam L of laser light from the laser scanner unit 3 scans (exposes) the peripheral surface of the drum 1.

The left and right walls of each of the cartridge slots 70*a*-70*d* are provided with a cartridge guiding means 75 for guiding a cartridge P when the cartridge P is inserted into the cartridge slot. The right-hand wall of the cartridge slot 70*a* (side from which cartridge is not driven) is provided with guides 75*a*1 and 75*a*3 for guiding the cartridge Pk when the cartridge Pk is inserted into the cartridge drawer 70 (cartridge slot 70*a*). The left-hand wall of the cartridge slot 70*a* (side from which cartridge is driven) is provided with guides 75*a*2 and 75*a*4 for guiding the cartridge Pk when the cartridge Pk is inserted into the cartridge drawer 70 (cartridge slot 70*a*). Similarly, the right-hand wall of the cartridge slot 70*b* is provided with guides 75*b*1 and 75*b*3 for guiding the cartridge Pc when the cartridge Pc is inserted into the cartridge drawer 70 (cartridge slot 70*c*). The left-hand wall of the cartridge slot 70*b* is provided with guides 75*b*2 and 75*b*4 for guiding the cartridge Pc when the cartridge Pc is inserted into the cartridge drawer 70 (cartridge slot 70*b*). The right-hand wall of the cartridge slot 70*c* is provided with guides 75*c*1 and 75*c*3 for guiding the cartridge Pm when the cartridge Pm is inserted into the cartridge drawer 70 (cartridge slot 70*c*). The left-hand wall of the cartridge slot 70*c* is provided with guides 75*c*2 and 75*c*4 for guiding the cartridge Pm when the cartridge Pm is inserted into the cartridge drawer 70 (cartridge slot 70*c*). Further, the right-hand wall of the cartridge slot 70*d* is provided with guides 75*d*1 and 75*d*3 for guiding the cartridge Py when the cartridge Py is inserted into the cartridge drawer 70 (cartridge slot 70). The left-hand wall of the cartridge slot 70*d* is provided with guides 75*d*2 and 75*d*4 for guiding the cartridge Py when the cartridge Py is inserted into the cartridge drawer 70 (cartridge slot 70*d*).

In this embodiment, the guides 75*b*, 75*c* and 75*d*, which are referred to as the first guides, are the same in shape. Thus, the first guide is described with reference to the guide 75*b*. Referring to FIG. 6(*a*), the right-hand wall of the cartridge slot 70*b* is provided with the guides 75*b*1 and 75*b*3, as described above. In terms of the direction D2 (outward direction), the guides 75*b*1 and 75*b*3 are on the upstream and downs stream sides, respectively. The two guides 75*b*1 and 75*b*3 are the same in width, and are roughly vertical. They are linear. Next, referring to FIG. 6(*b*), the left-hand wall of the cartridge slot 70*b* is provided with the guides 75*b*2 and 75*b*4, which are on the upstream and downstream sides, respectively, in terms of the direction D (outward direction). The two guides 75*b*2 and 75*b*4 are roughly vertical, and oppose the guides 75*b*1 and 75*b*3, respectively, of the right-hand wall of the cartridge slot 70*b*. The cartridge guide 63*g* of the cartridge Pm, which engages with the guide 75*b*2 of the cartridge drawer 70, which is a cylindrical rib which surrounds a coupling 47, as will be described later. Therefore, the guide 75*b*2 is different in width from the other guides. Thus, it is primarily the guides 75*b*3 and 75*b*4, which extend further downward than the guides 75*b*1 and 75*b*2, that guide the cartridge Pm.

As for the guide 75*a* of the most upstream cartridge slot 70*a* in terms of the direction D2 (outward direction), it is differently structured from the three downstream guides 75*b*, 75*c* and 75*d*. The guides 75*a*1 and 75*a*2 are the same in shape as the above described guides 75*b*1 and 75*b*2. The guides 75*a*3 and 75*a*4, which are going to be referred to as the second guides, are made up of the two sections, that is, the top and bottom sections. The bottom sections 75*a*3*a* and 75*a*4*a* are roughly vertical as the guides 75*b*3 and 75*b*4, but the top sections 75*a*3*b* and 75*a*4*b* are tilted frontward (outward direction D2). Referring to FIG. 7, designated by a referential code θ1 is the angle between the direction D2 in which the cartridge drawer 70 is pulled out of the apparatus main assembly 100A, and the direction C1, in which the cartridges Pm, Pc and Pk are to be pulled out of the drawer 70, and which is roughly parallel to the bottom section of the guide 75*a*3. The cartridge slot 70*a* is structured so that an angle θ2 between the outward direction D2, and the direction D3 in which the cartridge Py is moved when it is guided by the top section of the guide 575*a*3 is substantially smaller than 90°. That is, the guides 75*a*3 and 75*a*4 have slant sections 75*a*3*b* and 75*a*4*b*, respectively, which are more tilted downstream in terms of the outward direction D2 than the guides 75*b*, 75*c* and 75*d*.

The left wall of the cartridge drawer 70 (from which cartridge P is driven) has an opening 77 through which the drum coupling (unshown) put, and an opening 78 through which the developing means coupling (unshown) is put. Each coupling is put through the opening 77 or 78 by the closing movement of the door 10. Then, it engages with the corresponding coupling (which will be described later) of the cartridge P, and transmits to the cartridge P the force for driving the cartridge P.

(Cartridge)

Next, referring to FIGS. 2(*b*), 8(*a*), 8(*b*), 9(*a*) and 9(*b*), the cartridge P, which is installed in (supported by) the cartridge drawer 70, is described. FIG. 2(*b*) is an enlarged schematic sectional view of the combination of the cartridge drawer 70, cartridges P in the drawer 70, and their adjacencies, in FIG. 2(*a*), which is a schematic sectional view of the image forming apparatus 100 at a plane perpendicular to the front panel of the apparatus main assembly 100A, as seen from the front side of the apparatus 100. Here, the cartridge Pk is described as an example of the cartridge P. The cartridges Py, Pm and Pc are the same in structure as the cartridge Pk, although they are different from the cartridge Pk in the color of the toner they store. However, the cartridge Py is different from the other cartridges Pm, Pc and Pk in the shape of the hand-hold; it has a hand-hold 66, which will be described later.

The cartridge Pk is made up of a photosensitive member unit 8 and a development unit 4*k*, which are in connection to each other. The unit 8 has the drum 1, charge roller 2, cleaning means 6, and a developer storage 81 (in which developer removed by cleaning means 6 is stored). The development unit 4*k* has the development roller 40, developer supply roller 43, development blade 44, and developer storage 41*k* (in which developer Tk for image formation is stored).

The drum 1, development roller 40 and developer supply roller 43 are rotationally driven in the direction indicated by arrow marks. The charge roller 2 is rotated by the rotation of the drum 1. To the charge roller 2, a preset charge bias is applied. To the development roller 40, a preset development bias is applied.

The developer Tk in the developer storage 41*k* is conveyed upward to the developer supply roller 43 by a developer conveyance member 42, which is made up of a center shaft, and a sheet attached to the center shaft. Then, the developer Tk is coated on the peripheral surface of the development roller 40 by the developer supply roller 43, and the development blade 44 which is kept pressed on the peripheral surface of the development roller 40. As the developer Tk is coated on the peripheral surface of the development roller 40, electrical charge with a preset polarity is given to the developer Tk by the blade 44. To the development roller 40, the preset development bias is applied from the apparatus main assembly 100A, whereby an electrostatic latent image formed on the drum 1 is developed into a visible image formed of the developer. The developer remaining on the peripheral surface of the drum 1 after the transfer of the developer image onto a sheet S of recording medium is removed by the cleaning means 6, and is stored in the developer storage 81 for the removed developer.

Figure 8:
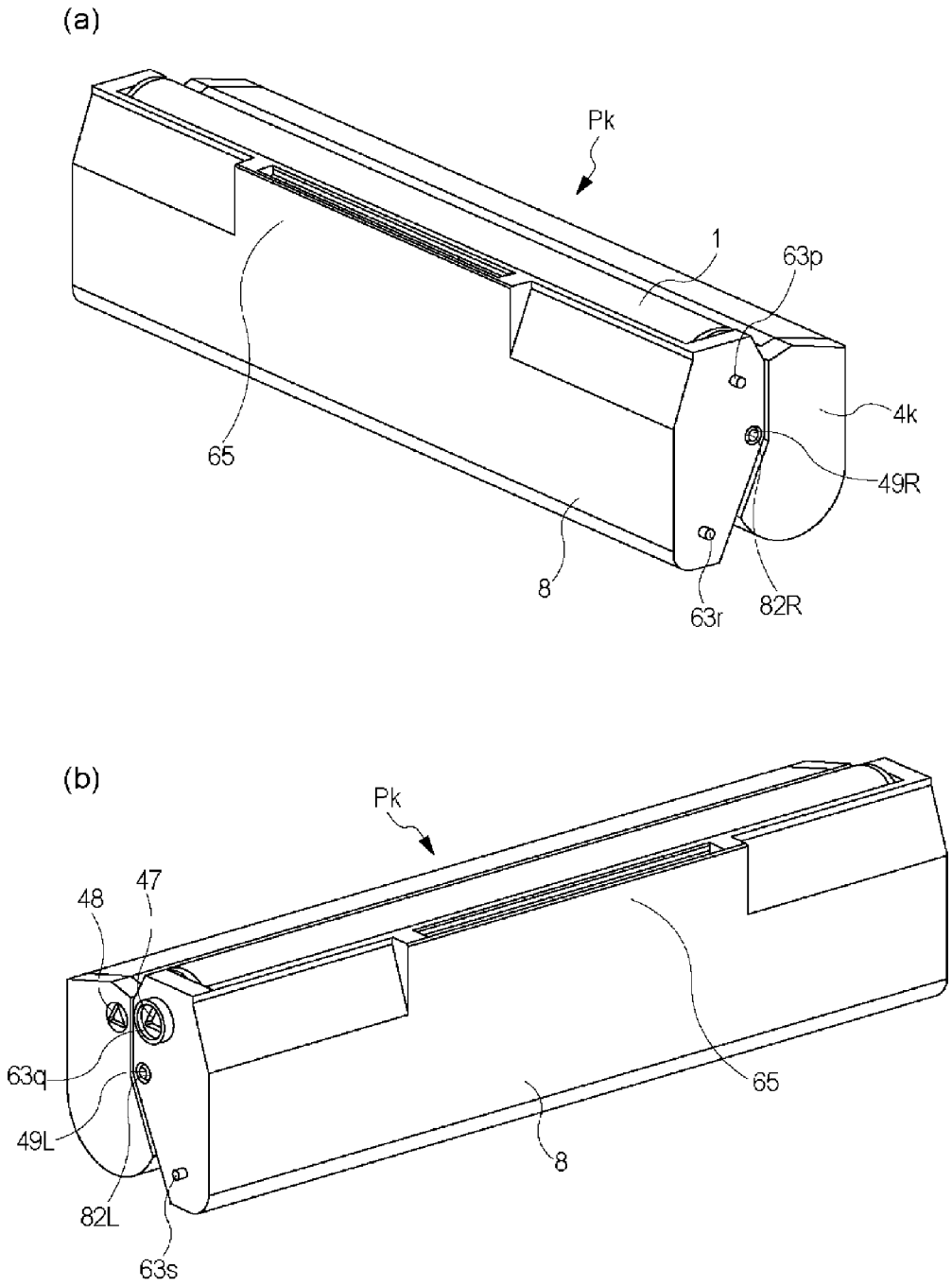
FIGS. 8(*a*) and 8(*b*) are perspective views of the cartridge Pk as seen from the top-left and top-right sides, respectively, of the cartridge Pk.

FIGS. 8(*a*) and 8(*b*) are perspective views of the cartridge Pk as seen from the top-right and top-left of the cartridge Pk, respectively. The lengthwise end of the cartridge Pk, from which the cartridge Pk is driven, has: a rotatable coupling 47, through which the cartridge Pk receives the drum driving force from the drum coupling (unshown) of the apparatus main assembly 100A; and a rotatable coupling 48, through which the cartridge Pk receives the development roller driving force from the developer roller coupling (unshown) of the apparatus main assembly 100A.

The coupling 47 is attached to the left end of the drum 1 (from which drum 1 is driven). The driving force which the coupling 47 receives from the apparatus main assembly 100A rotates the drum 1. The driving force which the coupling 48 receives from the apparatus main assembly 100A rotates the development roller 40. It is also transmitted to the developer conveyance member 48 and developer supply roller 43 through intermediary gears (unshown).

The left and right walls of the cartridge P are provided with guides 63, one for one, which guide the cartridge P by engaging with the guide 75 when the cartridge P is inserted into the cartridge drawer 70. More concretely, referring to FIG. 8(*a*), the right wall of the cartridge Pk is provided with guides 63*p* and 63*r*, which are cylindrical and project outward from the outward surface of the right wall. The guide 63*r* is below the guide 63*p*. Next, referring to FIG. 8(*b*), the left wall of the cartridge Pk is provided with guides 63*q* and 63*s*, which are on the outward surface of the left wall. The guide 63*q* is cylindrical and surrounds the coupling 47. The guide 63*s* is below the guide 63*q* and is cylindrical.

The photosensitive member unit 8 is provided with holes 82R and 82L, whereas the development unit 4*k* is provided with projections 49R and 49L. The photosensitive member unit 8 and development unit 4 are in connection to each other, with the projections 49R and 49L fitted in the holes 82R and 82L, respectively.

Figure 9:
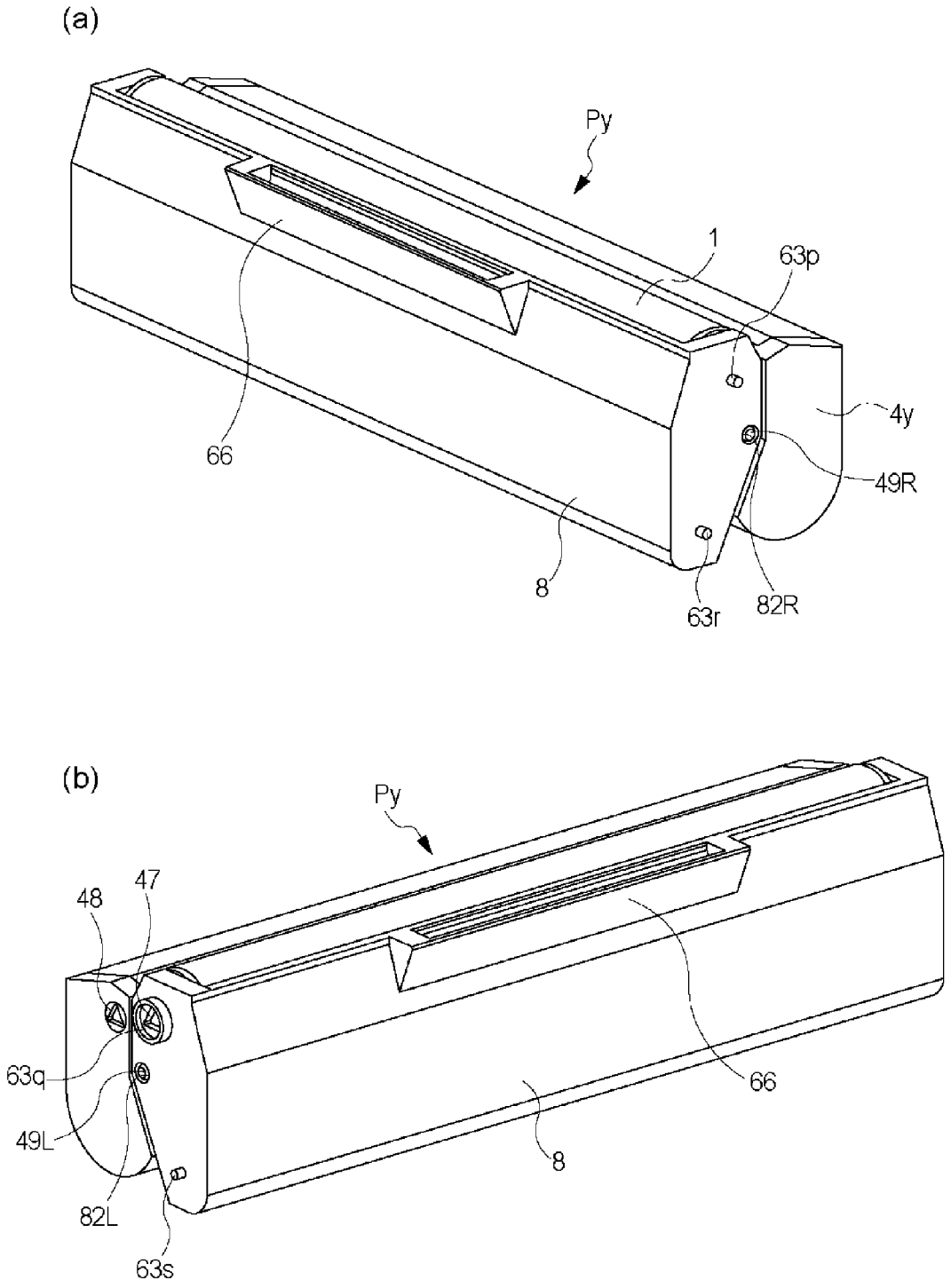
FIGS. 9(*a*) and 9(*b*) are perspective views of the cartridge Py as seen from the top-left and top-right sides, respectively, of the cartridge Py.

FIGS. 9(*a*) and 9(*b*) are perspective views of the cartridge Py as seen from the top-left and top-right sides, respectively, of the cartridge Py. The cartridge Py is different from the cartridges Pm, Pc and Pk only in the shape of the hand-hold; the hand-hold 66 of the cartridge Py is different in shape from the hand-hold 66 of the cartridges Pm, Pc and Pk. Otherwise, the structure of the cartridge Py is the same as the above described structure of the cartridge Pk. Referring to FIGS. 8(*a*) and 8(*b*), the hand-holds 65 of the cartridges Pm, Pc, and Pk are roughly vertical. In comparison, the hand-hold 66 of the cartridge Py is tilted frontward.

(Installation of Cartridge into Cartridge Drawer; Supporting of Cartridge by Cartridge Drawer)

Figure 10:
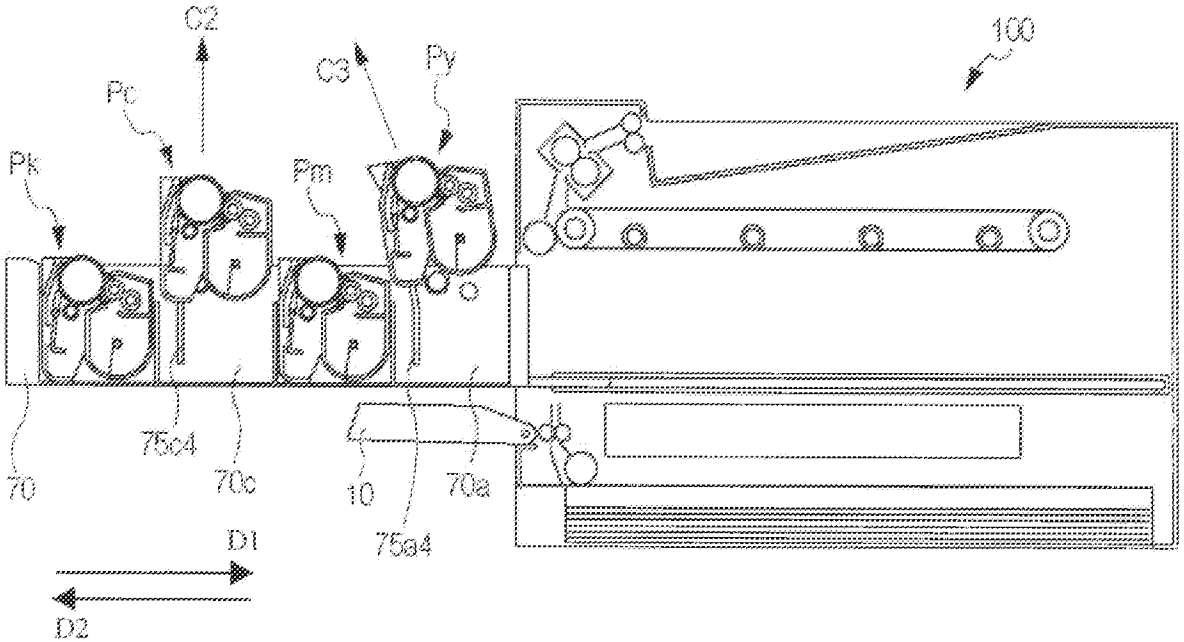
FIG. 10 is a schematic vertical sectional view of the image forming apparatus 100, at a plane parallel to the moving direction of its cartridge drawer, as seen from the right-hand side of the image forming apparatus 100, when the drawer is in the preset outside position and the cartridges Pc and Py are being taken out of the drawer.

Next, referring to FIGS. 6-10, the installation of each cartridge P (Py, Pm, Pc and Pk) into the cartridge drawer 70 (supporting of each cartridge P by drawer 70) is described. FIG. 10 is a schematic vertical sectional view of the image forming apparatus 100, at a plane parallel to the moving direction of its cartridge drawer, as seen from the right-hand side of the image forming apparatus 100, when the drawer is in the preset outside position and the cartridges Pc and Py are being taken out of the drawer.

The cartridges Py, Pm, Pc and Pk are to be installed into the cartridge slots 70*a*, 70*b*, 70*c* and 70*d*, respectively, of the cartridge drawer 70. A user is to insert each cartridge P downward into the corresponding cartridge slot in the direction indicated by the arrow mark C2, which is virtually the same as the gravity direction. Here, the installation of the cartridge P into the cartridge drawer 70 is described using the cartridge Pc as an example. The cartridges Pm, Pc and Pk are the same in installation, except for their slot in the drawer 70. The installation of the cartridge Py is described later.

When it is necessary for a user to install the cartridge Pc into the cartridge slot 70*c* of the cartridge drawer 70, the user is to grasp the hand-hold 65, and insert the cartridge Pc into the cartridge slot 70*c* so that the guides 63*r* and 63*s* of the left and right walls of the cartridge Pc engage with the guides 75*c*3 and 75*c*4 of the cartridge slot 70*c*, respectively. Thus, as the user inserts the cartridge Pc into the cartridge slot 70*c*, the cartridge Pc slides downward into the slot 70*c* in the direction C2 while being guided by the guides 75*c*3 and 75*c*4, which are in engagement with the guides 63*r* and 63*s*. Then, the user is to engage the guides 63*p* and 63*q* with the guides 75*c*1 and 75*c*2, respectively, and slide the cartridge Pc further downward in the direction C2. Eventually, the guide 63 comes into contact with the bottom of the guide 75, completing the installation of the cartridge Pc into the cartridge drawer 70.

Next, the installation of the cartridge Py into the cartridge drawer 70 is described. The user is to grasp the hand-hold 66, and insert the cartridge Py into the cartridge slot 70*a* so that the guides 63*r* and 63*s* of the left and right walls of the cartridge Py engage with the guides 75*a*3 and 75*a*4 of the cartridge slot 70*a*, respectively. Then, the user is to allow the gravity to slide the cartridge Py downward in the direction C2. However, the guides 75*a*3 and 75*a*4 are tilted in the direction C3 (frontward) as described above. Therefore, the cartridge Py lowers aslant; it slides downward while moving rearward. Lastly, the user is to engage the guides 63*p* and 63*q* with the guides 75*a*1 and 75*a*2, respectively, and slide the cartridge Py further downward. Eventually, the guide 63 comes into contact with the bottom of the guide 75, completing the installation of the cartridge Py into the cartridge drawer 70.

When it is necessary to take out a cartridge P in the cartridge drawer 70, a user is to carry out in reverse the above-described operation for installing the cartridge P. More concretely, if a user wants to take the cartridge Pc out of the drawer 70, the user is to grasp the hand-hold 65 the cartridge Pc, and pull the cartridge Pc in the direction D2, that is, the vertical direction. As the cartridge Pc is pulled upward, the guides 63*p* and 63*q* disengage from the guides 75*c*1 and 75*c*2, and then, the guides 63*r* and 63*s* disengage from the guides 75*c*3 and 75*c*4, allowing thereby the user to take the cartridge Pc out of the cartridge drawer 70. The operation for taking the cartridge Pm out of the drawer 70, and the operation for taking the cartridge Pk from the drawer 70, are the same as the operation for taking the cartridge Pc from the drawer 70.

The operation for taking the cartridge Py out of the cartridge drawer 70 is as follows: First, a user is to grasp the hand-hold 66 of the cartridge Py, and pull up the cartridge Py in the direction C2, that is, the vertical direction, as the user has to do when taking the cartridge Pc out of the drawer 70. As the cartridge Py is pulled upward, the guides 63*p* and 63*q* disengage from the guides 75*a*1 and 75*a*2, respectively. Then, the user is to pull the cartridge Py further upward. As the cartridge Py is pulled, the guides 63*r* and 63*s* (which are in engagement with guides 75*a*3 and 75*a*4, respectively), the cartridge Py (to which guides 63*r* and 63*s* belong) move askew in the direction C3, because the guides 75*a*3 and 75*a*4 are tilted in the direction C3. That is, the cartridge Py is moved upward while shifting frontward of the apparatus main assembly 100A. Lastly, the guides 63*r* and 63*s* disengage from the guides 75*a*3 and 75*a*4, allowing thereby the user to take the cartridge Py out of the cartridge drawer 70. That is, the cartridge Py and cartridge slot 70*a* are structured so that the distance by which the guides 75*a*3 and 75*a*4 are moved in the direction D2 (outward direction) when the cartridge Py is taken out of the cartridge drawer 70 is greater than the distance by which the cartridges Pk, Pc and Pm are moved whey they are taken out of the drawer 70.

It is from the front side of the image forming apparatus 100, facing the front panel of the image forming apparatus 100, that a user is to carry out the above described operation for installing or removing a cartridge P (front access). Therefore, when the user installs the cartridge Py into the cartridge drawer 70, or takes the cartridge Py out of the drawer 70 after moving frontward the drawer 70 to the preset outside position by pulling the drawer 70 frontward, the cartridge slot 70*a* for the cartridge Py is the farthest of the four cartridge slots of the drawer 70 from the user. However, the guide 75*a* is differently structured from the guides 75*b*-75*d*. Therefore, a user is enabled to engage the guide 63 of the cartridge Py with the guide 75*a* of the drawer 70, or disengage the guide 63 of the cartridge Py from the guide 75*a* of the drawer 70, at a point closer to the user than if the cartridge Py and cartridge slot 70*a* were structured the same as the other cartridges Pm, Pc, and Pk and cartridge slots 70*b*, 70*c* and 70*d*. That is, when the cartridge Py is installed, it is guided into its cartridge slot, that is, the cartridge slot 70*a*, from a point closer to the user than if the cartridge Py and the cartridge slot 70*a* were structured the same as the other cartridges and their slots in the drawer 70. Further, when the cartridge Py is taken out of the cartridge drawer 70, it is guided to a point closer to the user than if the cartridge Py and cartridge slot 70*a* were structured the same as the other cartridges and their slots in the drawer 70. In other words, the structural arrangement for the cartridge Py (which is supported most upstream in cartridge drawer 70 in terms of direction D2 (outward direction)), and the structural arrangement for the cartridge slot 70*a* for the cartridge Py, substantially improves the image forming apparatus 100 in operability in terms of the installation and removal of the cartridge Py.

The guide 75*a* in this embodiment shifts frontward, the point at which the cartridge Py engages with the guide 75*a*, or disengages from the guide 75*a* compared to a conventionally structured guide (75*a*). That is, the point at which the cartridge Py is engaged with the guide 75*a* when it is installed into the cartridge drawer 70, or disengaged from the guide 70*a* when it is taken out of the drawer 70, is farther from the apparatus main assembly 100A than that in the case of a conventionally structured guide (75*a*). Therefore, the cartridge Py and apparatus main assembly 100A are less likely to be made to contact with each other during the installation or removal of the cartridge Py. Therefore, the drum 1 of the cartridge Py surface of the cartridge Py, and surface of the apparatus main assembly 100A, are less likely to be damaged.

In this embodiment, the cartridge P is installed in the cartridge drawer 70 in such an attitude that the photosensitive member unit 8 which includes the drum 1 of the cartridge P will be on the front side of the development unit 4 of the cartridge P after the installation. In other words, the cartridge P is installed in the drawer 70 in such an attitude that the photosensitive drum unit 8 having the drum 1 will be farther away from the apparatus main assembly 100A. Therefore, the drum 1 is less likely to be damaged.

Further, it is possible that when a user grasps the cartridge P, the user will touch the drum 1. In this embodiment, therefore, the hand-hold 65, which is the hand-hold of the second type, is positioned so that when the cartridge P is in the cartridge drawer 70, the hand-hold 65 is on the front side of the drum 1. Therefore, the user is unlikely to touch the drum 1 when the user is installing or uninstalling the cartridge P. Therefore, the drum 1 is unlikely to be damaged by the user when the cartridge P is installed or uninstalled.

As described above, the hand-hold 66 of the cartridge Py is different in shape from the hand-hold 65, that is, the hand-hold of the first type, of the cartridges Pm, Pc and Pk; it is shaped so that when the cartridge Py is in the cartridge drawer 70, its front surface is tilted frontward. Therefore, as a user grasps the hand-hold 66 of the cartridge Py, the user can immediately know that the cartridge P grasped by the user is different from the other cartridges P in the manner in which it is to be installed or uninstalled. Further, tilting the hand-hold 66 of the cartridge Py frontward (toward user) can improve the cartridge Py in operability in terms of its installation or uninstallation.

Also in this embodiment, the guides 75*a*3 and 75*a*4 of the guide 75*a* are shaped so that they are the same in the bottom section as the guides 75*b*-75*d*, but, different in the top section from the guides 75*b*-75*d* (top section of the guides 75*a*3 and 75*a*4 are tilted frontward). It is possible to tilt frontward the guides 75*a*3 and 75*a*4 in entirety, or tilt their bottom section frontward and keep their top section vertical. Such modifications, however, makes it necessary to increase the cartridge drawer 70 in cartridge interval, and/or to provide the cartridges P with a recess. Therefore, the modifications are likely to result in an increase in image forming apparatus size and/or result in reduction in cartridge capacity, being therefore, undesirable.

Also in this embodiment, each of the guides 75*a*3 and 75*a*4 is a combination of two straight sections which are different in angle. However, they may be straight, or a combination of three straight sections different in angle. Further, a part of them may be curved like an arc.

Further, the cartridges Pm, Pc and Pk are structured so that their guides 75*b*-75*d* are linear, and also, so that when they are in the cartridge drawer 70, their guides 75*b*-75*d* are vertical. However, this embodiment is not intended to limit the present invention in the shape and angle of the guides 75*b*-75*d*. That is, the cartridge Pm, Pc and Pk may be structured so that when they are in the cartridge drawer 70, the guides 75*b*-75*d* are tilted. Even if the front guides 75*b*-75*d* are tilted, the same effects as those obtainable by this embodiment can be obtained by forming the guide 75*a* so that the angle θ2 becomes less than the angle θ1.

Embodiment 2

Next, the second embodiment of the present invention is described. However, the components, portions, etc., of the image forming apparatus in this embodiment, which are the same in structure and function as the counterparts in the first embodiment, are given the same referential codes as those given to the counterparts, and are not going to be described here. That is, only those different in structure and function from the counterparts in the first embodiment are described.

(General Structure of Electrophotographic Color Image Forming Apparatus)

Figure 11:
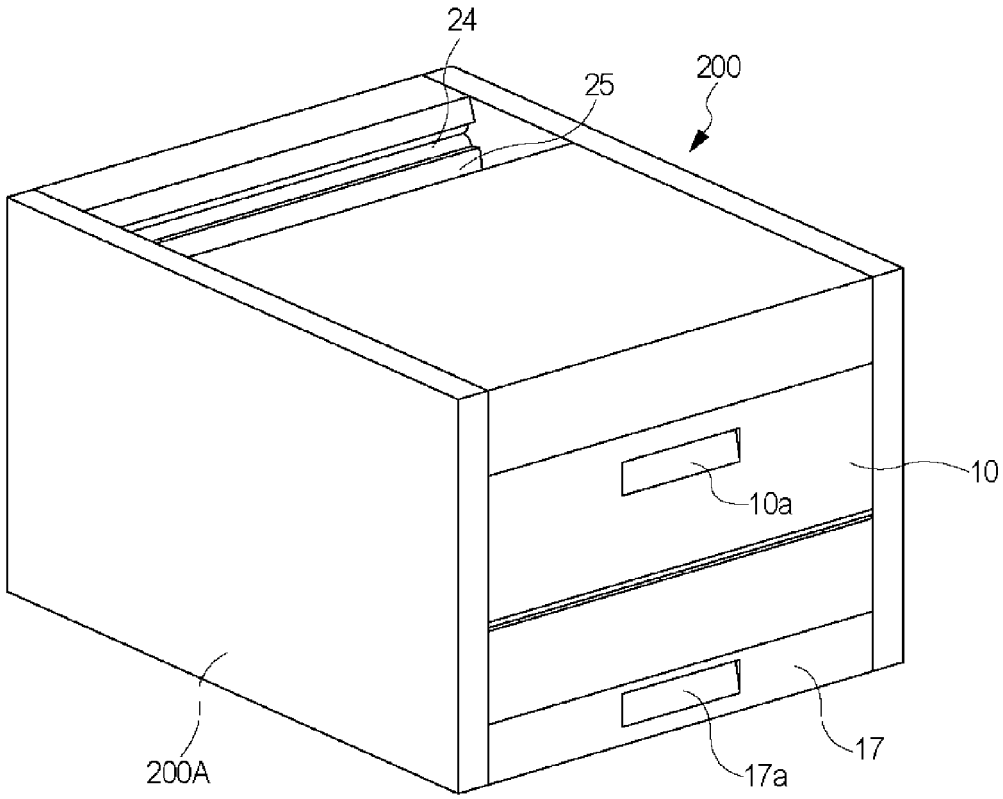
FIG. 11 is an external perspective view of the image forming apparatus 200 in the second embodiment of the present invention.
Figure 12:
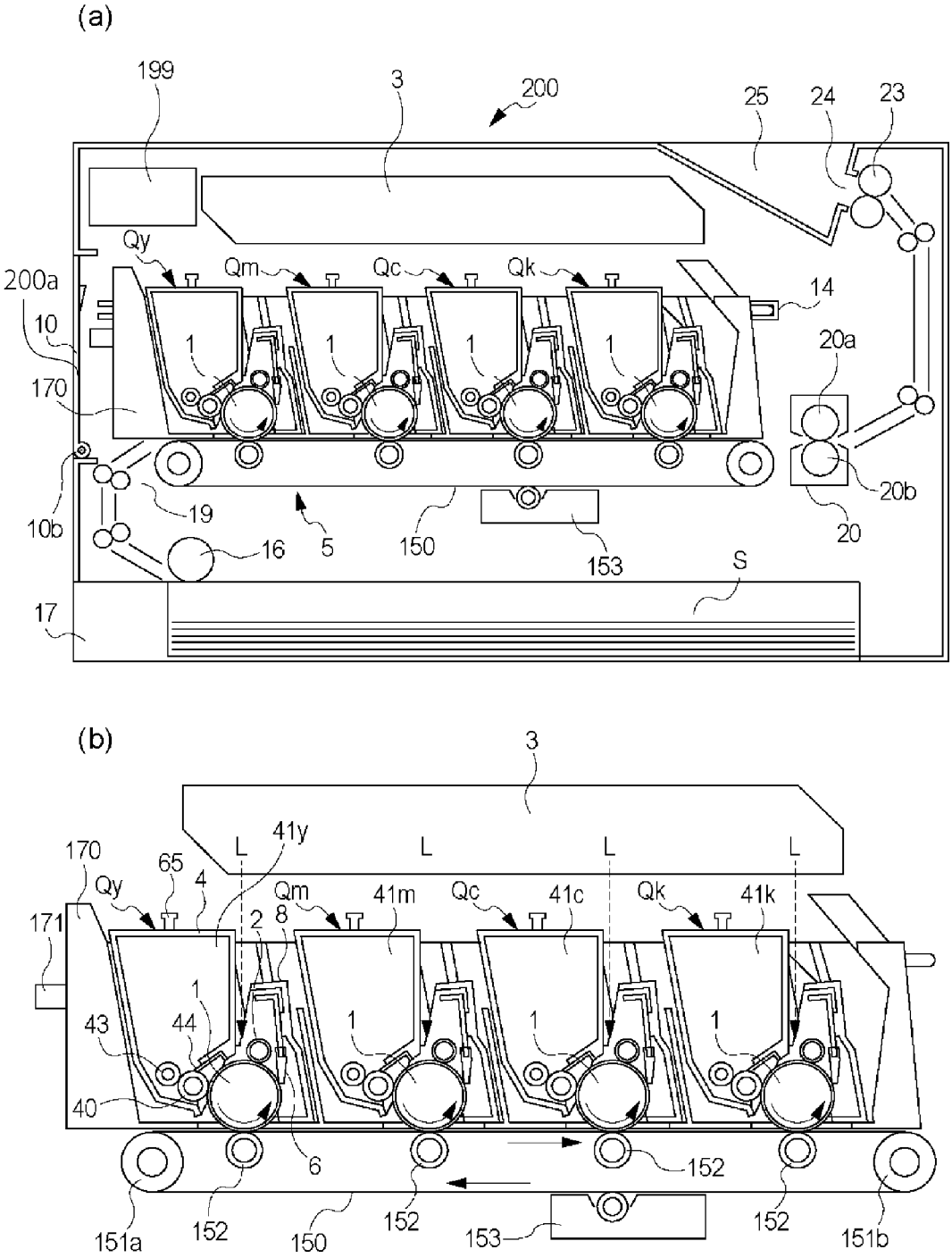
FIG. 12(*a*) is a vertical schematic sectional view of the image forming apparatus 200 at a vertical plane perpendicular to the front panel of the apparatus 200, as seen from the right-hand side of the apparatus 200. It shows the general structure of the apparatus 200.
Figure 13:
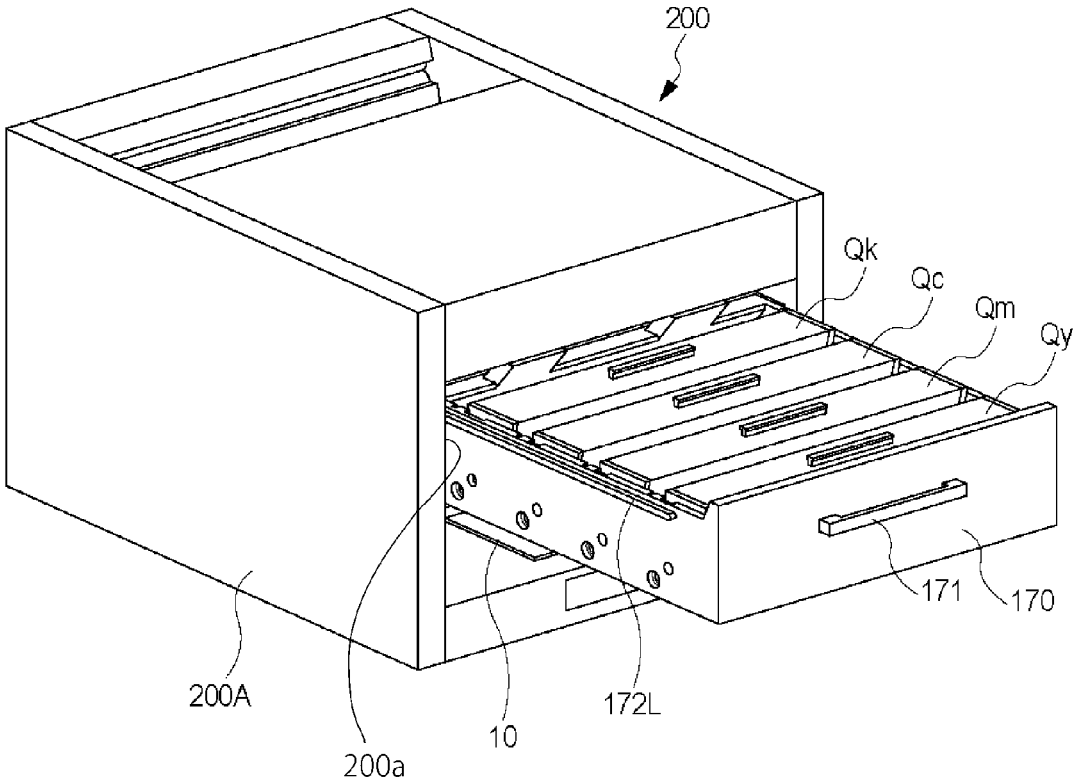
FIG. 13 is a perspective view of the image forming apparatus 200, the cartridge drawer of which is in its preset outside position.

FIG. 11 is an external perspective view of the electrophotographic color image forming apparatus 200 (which hereafter will be referred to simply as image forming apparatus 200) in this embodiment. FIG. 12(*a*) is a vertical schematic sectional view of the image forming apparatus 200 at a vertical plane perpendicular to the front panel of the apparatus 200, as seen from the right-hand side of the apparatus 200. FIG. 2(*b*) is an enlargement of a part of FIG. 12(*a*). The image forming apparatus 200 is a full-color laser printer based on the four primary colors. It uses an electrophotographic process.

In the following description of the second embodiment, the front side of the image forming apparatus 200 is the side having a door 10. The rear (back) side of the image forming apparatus 200 is the opposite side of the apparatus 200 from the front side. The front-rear direction of the apparatus 300 includes both the front-to-rear direction (rearward direction) and the rear-to-front direction (frontward direction), that is, the opposite direction from the front-to-rear direction. The left-right direction means both the right-to-left direction (leftward direction) and the left-to-right direction (rightward direction). Further, the main assembly 200A is what remains after the removal of the cartridges P from the image forming apparatus 200.

The image forming apparatus 200 in this embodiment is an image forming apparatus of the so-called horizontal type and also, of the so-called tandem type. That is, it employs four process cartridges Q (Qy, Qm, Qc and Qk) which form yellow (y), magenta (m), cyan (c) and black (k) developer images (toner images), respectively. The four process cartridges Q are horizontally aligned in tandem in the apparatus main assembly 200A. They are removably installable in the apparatus main assembly 200A to form a color image on a sheet S of recording medium.

More concretely, in the apparatus main assembly 200A, the four process cartridges Q, that is, the first to fourth process cartridges Qy, Qm, Qc and Qk, respectively, are roughly horizontally aligned in tandem in the front-to-rear direction in the apparatus main assembly 200A. Each process cartridge Q (which hereafter is referred to simply as cartridge Q) has an electrophotographic photosensitive drum 1 (which hereafter is referred to simply as drum 1), on which an electrostatic latent image is formed. Referring to FIG. 12, the drum 1 is rotated in the clockwise direction of FIG. 2. Each process cartridge Q has also a charging mean 2, a developing means 4 (4*y*, 4*m*, 4*c* or 4*k*), and a drum cleaning means 6, which are means for processing the drum 1.

The apparatus main assembly 200A has a laser scanner unit 3, which is above the cartridge space, that is, the space into which the cartridges Q (Qy, Qm, Qc and Qk) are installed. It has also a transfer unit 5 (as transferring means), which is on the bottom side of the cartridge space.

The transfer unit 5 has an electrostatic transfer belt 150 (which hereafter is referred to simply as transfer belt 150), which is dielectric and flexible. It has also the first (front) and second (rear) rollers 151*a* and 151*b*, by which the transfer belt 150 is suspended and kept stretched. Further, the transfer unit 5 has four primary transfer rollers 152 (152*y*, 152*m*, 152*c* and 152*k*), which are inside the loop which the transfer belt 150 forms. In terms of the moving direction of the transfer belt 150, the primary transfer rollers 52 are between the first and second rollers 151*a* and 151*b*. They are kept pressed against the drums 1 of the corresponding cartridges Q with the presence of the transfer belt 150 between themselves and drums 1, one for one. The area of contact between the drum 1 of each cartridge Q and the transfer belt 150 is the primary transfer nip. As the second roller 151*b* is driven, the transfer belt 150 circularly moves in the clockwise direction (indicated by arrow mark in drawing) at a speed which corresponds to the rotational speed of the drum 1. There is a belt cleaning means 153 under the transfer belt 150. The belt cleaning means 153 removes the contaminants on the belt 150.

The operation for forming a full-color image is as follows: The four cartridges Q are sequentially driven with preset control timing. That is, each drum 1 is rotationally driven in the counterclockwise direction (indicated by arrow mark in FIG. 2). Then, a developer image is formed by the drum 1 of each cartridge Q through an electrophotographic process similar to the one in the first embodiment.

Meanwhile, a sheet S of recording medium is fed into the apparatus main assembly 200A by a sheet conveyance roller 18 of a recording medium feeder section 16 with a preset timing, and is moved onto the transfer belt 150 by a pair of registration rollers 19, from the front side, with a preset timing. As the sheet S is moved onto the transfer belt 150, it is electrostatically adhered to the transfer belt 150. Then, it is sequentially conveyed through the transfer nips of the cartridges Qy, Qm, Qc and Qk by the circular movement of the transfer belt 150. To each of the transfer rollers 152, a preset transfer bias is applied from an electric power source (unshown), whereby four developer images, different in color (yellow, magenta, cyan, and black), are transferred in layers onto the sheet S of recording medium, effecting thereby an unfixed full-color developer image on the sheet S.

Then, the sheet S of recording medium is separated from the surface of the belt 11, and is introduced into a fixation section 20, and is conveyed through the fixation section 20. While the sheet S is conveyed through the fixation section 20, the sheet S and the unfixed full-color developer image thereon are given heat and pressure by the pair of fixation rollers 20*a* and 20*b* of the section 20. Thus, the unfixed full-color developer image made up of multiple (four) monochromatic images, different in color, is fixed to the surface of the sheet S. Then, the sheet S is conveyed through a recording medium conveyance passage which includes a pair of discharge rollers 23, and is discharged into an external delivery tray 25 of the apparatus main assembly 200A through a sheet delivery opening 24 of the apparatus main assembly 200A.

(Cartridge Replacement Method)

The method for replacing a cartridge P in the apparatus main assembly 200A of the image forming apparatus 200 in this embodiment is similar to the method for replacing a cartridge P in the apparatus main assembly 100A of the image forming apparatus 100 in the first embodiment. That is, the cartridges Q are placed in a cartridge drawer 170, which is a cartridge supporting member having a cartridge supporting frame. The cartridge drawer 170 can be pulled out of the apparatus main assembly 200A in the frontward direction, and therefore, the cartridges Q can be installed in the apparatus main assembly 200A, or uninstalled from the apparatus main assembly 200A, from the front side of the apparatus main assembly 200A.

(Cartridge Drawer)

Figure 15:
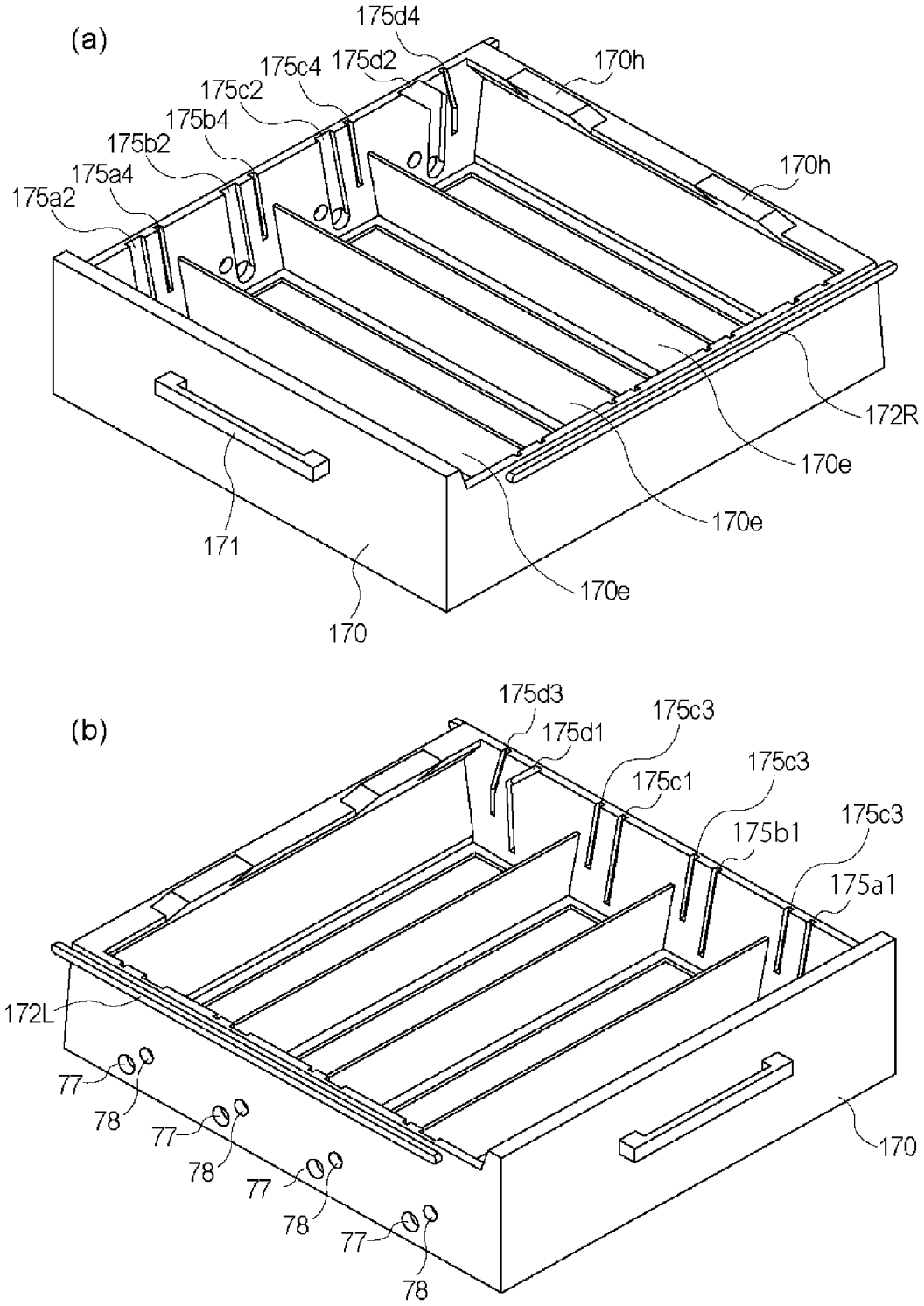
FIGS. 15(*a*) and 15(*b*) are perspective views of the cartridge drawer of the image forming apparatus 200, as seen from the top-left and top-right sides, respectively, of the drawer.
Figure 16:
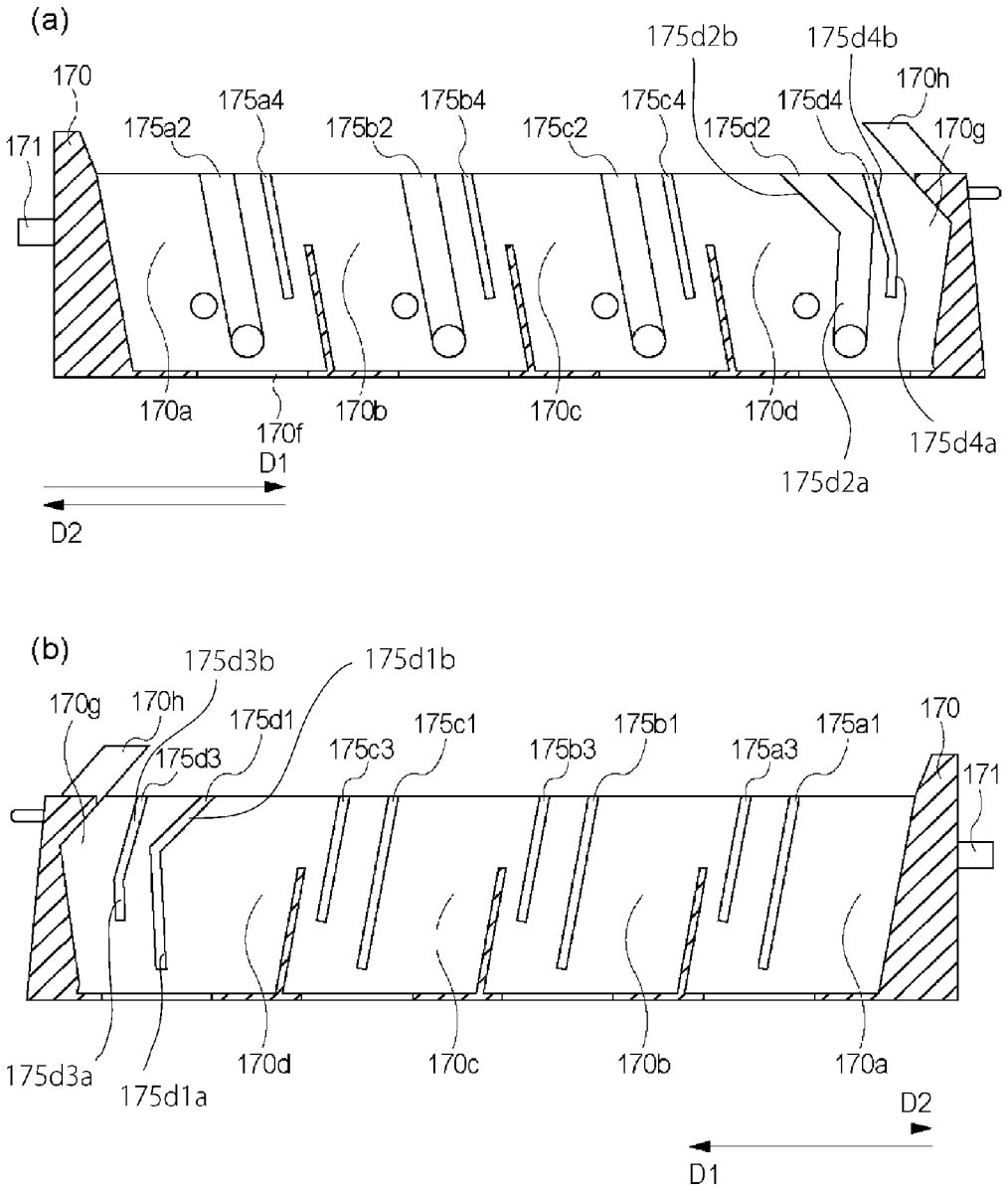
FIGS. 16(*a*) and 16(*b*) are schematic vertical sectional views of the cartridge drawer in the second embodiment, at a vertical plane parallel to the moving direction of the drawer, as seen from the left and right sides, respectively of the apparatus 100.
Figure 17:
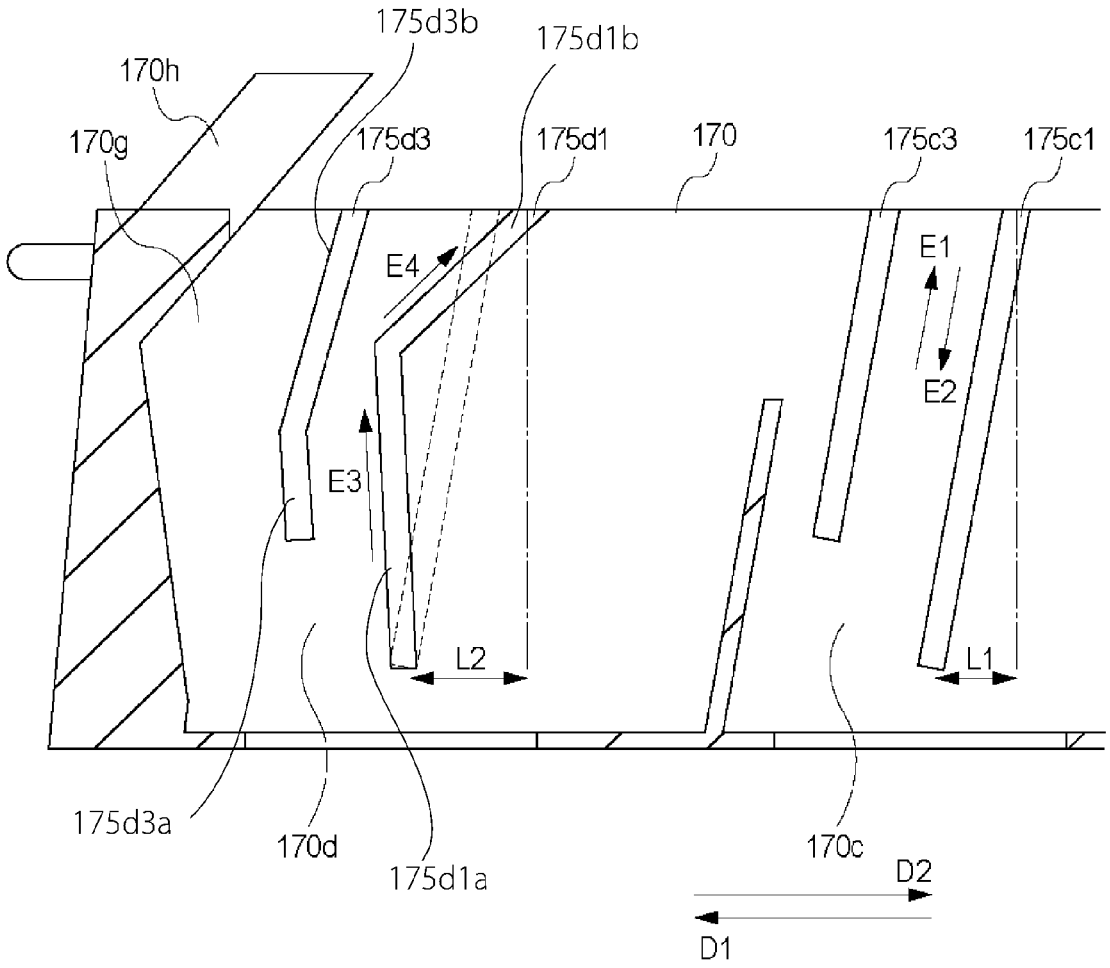
FIG. 17 is an enlarged schematic sectional view of the frontmost cartridge slot, and its adjacencies, of the cartridge drawer in the second embodiment.

Next, referring to FIGS. 15 to 17, the cartridge drawer 170 is described. FIG. 15(*a*) is a perspective view of the cartridge drawer 170 as seen from the top-right of the drawer 170. FIG. 15(*b*) is a perspective view of the cartridge drawer 170 as seen from the top-left of the drawer 170. FIG. 16(*a*) is a schematic vertical sectional view of the cartridge drawer 170, at a vertical plane parallel to the moving direction of the drawer 170 as seen from the right side of the apparatus 200. FIG. 16(*b*) is a schematic vertical sectional view of the cartridge drawer 170, at a vertical plane parallel to the moving direction of the drawer 170, as seen from the left side of the apparatus 200.

The right and left walls of the cartridge drawer 170 are provided with guides 172R and 172L, respectively, which are on the outward surface of the right wall and the outward surface of the left wall, respectively. The apparatus main assembly 200A is provided with right and left guiding grooves 14, in which the guides 172R and 172L engage to be guided by the guiding grooves 14, respectively. With the guides 172R and 172L engaged in the guiding grooves 14, the cartridge drawer 170 is roughly horizontally supported by the apparatus main assembly 200A and is movable in the front-rear direction.

The cartridge drawer 170 is provided with four cartridge slots 170*a*-170*d*, in which four cartridges Q, different in color of the developer, are installable one for one. The cartridge slots 170*a*-170*d* are aligned in tandem in the front-to-rear direction. Listing from the upstream side of the drawer 170 in terms of the direction D1 (in which drawer 70 is pushed into apparatus main assembly 200A), they are a cartridge slots 170*a* (second type), 170*b* (first type), 170*c* (first type) and 170*d* (first type). The cartridge slots 170*a*, 170*b*, 170*c* and 170*k* are the slots into which the cartridges Qy, Qm, Qc and Qk are to be installed, respectively. There is a partition plate 170*c* between the adjacent two cartridge slots. The bottom wall of each of the cartridge slots 170*a*-170*d* is provided with an opening 170*f*, through which the drum 1 of each cartridge Q contacts the transfer belt 150 or the sheet S of recording medium on the transfer belt 150.

The left and right walls of each of the cartridge slots 170*a*-170*d* are provided with a pair of guiding means 175, one for one, which are for installing a cartridge Q into the cartridge drawer 170. The right wall of the cartridge slot 170*a* is provided with guides 175*a*1 and 175*a*3, whereas the left wall of the cartridge slot 170*a* is provided with guides 175*a*2 and 175*a*4. The guides 175*a*1 and 175*a*2 oppose the guides 175*a*3 and 175*a*4, respectively. Similarly, the right wall of the cartridge slot 170*b* is provided with guides 175*b*1 and 175*b*3, whereas the left wall of the cartridge slot 170*b* is provided with guides 175*b*2 and 175*b*4; the right wall of the cartridge slot 170*c* is provided with guides 175*a*1 and 175*a*3, whereas the left wall of the cartridge slot 170*c* is provided with guides 175*c*2 and 175*c*4; and the right wall of the cartridge slot 170*d* is provided with guides 175*d*1 and 175*d*3, whereas the left wall of the cartridge slot 170*d* is provided with guides 175*d*2 and 175*d*4.

In this embodiment, the guides 175*a*-175*c* of the front three cartridge slots 170*a*-170*c*, respectively, are the same in shape. However, the guide 175*d* of the rearmost cartridge slot 170*d* (which is most upstream cartridge slot in terms of direction D2 (outward direction)) is different in shape from the guides 175*a*-175*c*. Each of the guides 175*d*1 and 175*d*2 is a combination of two (top and bottom) sections which are linear. Each of the bottom sections 175*d*1*a* and 175*d*2*a* of the guides 175*d*1 and 175*d*2, respectively, is tilted frontward (parallel to direction E3), whereas each of the top sections 175*d*1*b* and 175*d*2*b* of the guides 175*d*1 and 175*d*2, respectively, is tilted rearward (parallel to direction E4). Further, each of the guides 175*d*3 and 175*d*4 is also a combination of two (top and bottom) linear sections. The bottom sections 175*d*3*a* and 175*d*4*a* of the guides 175*d*3 and 175*d*4, respectively, are parallel to the bottom sections 175*d*1*a* and 175*d*2*a* of the guides 175*d*1 and 175*d*2, respectively.

Referring to FIG. 17, a referential code L1 stands for the distance between the top and bottom ends of the guide 175*c*1 in terms of the horizontal direction, and a referential code L2 stands for the distance between the top and bottom ends of the guide 175*d*1 in terms of the horizontal direction. The cartridge drawer 170 is structured so that L2 is larger than L1.

The rear wall of the cartridge slot 170*d* of the cartridge drawer 170 is provided with a recess 170*g*, which is in the form of a triangular pole (triangular in cross section at plane parallel to moving direction of cartridge drawer 70).

Further, the cartridge drawer 170 is provided with a pair of regulating sections 170*h*, which are at the top rear end of the drawer 170. Each regulating section 170*h* extends into the space above the cartridge slot 17*e* and recess 170*g*, but is not tall enough to prevent the cartridge drawer 170 from moving through the opening 200*a* of the image forming apparatus 200.

(Cartridge)

Figure 18:
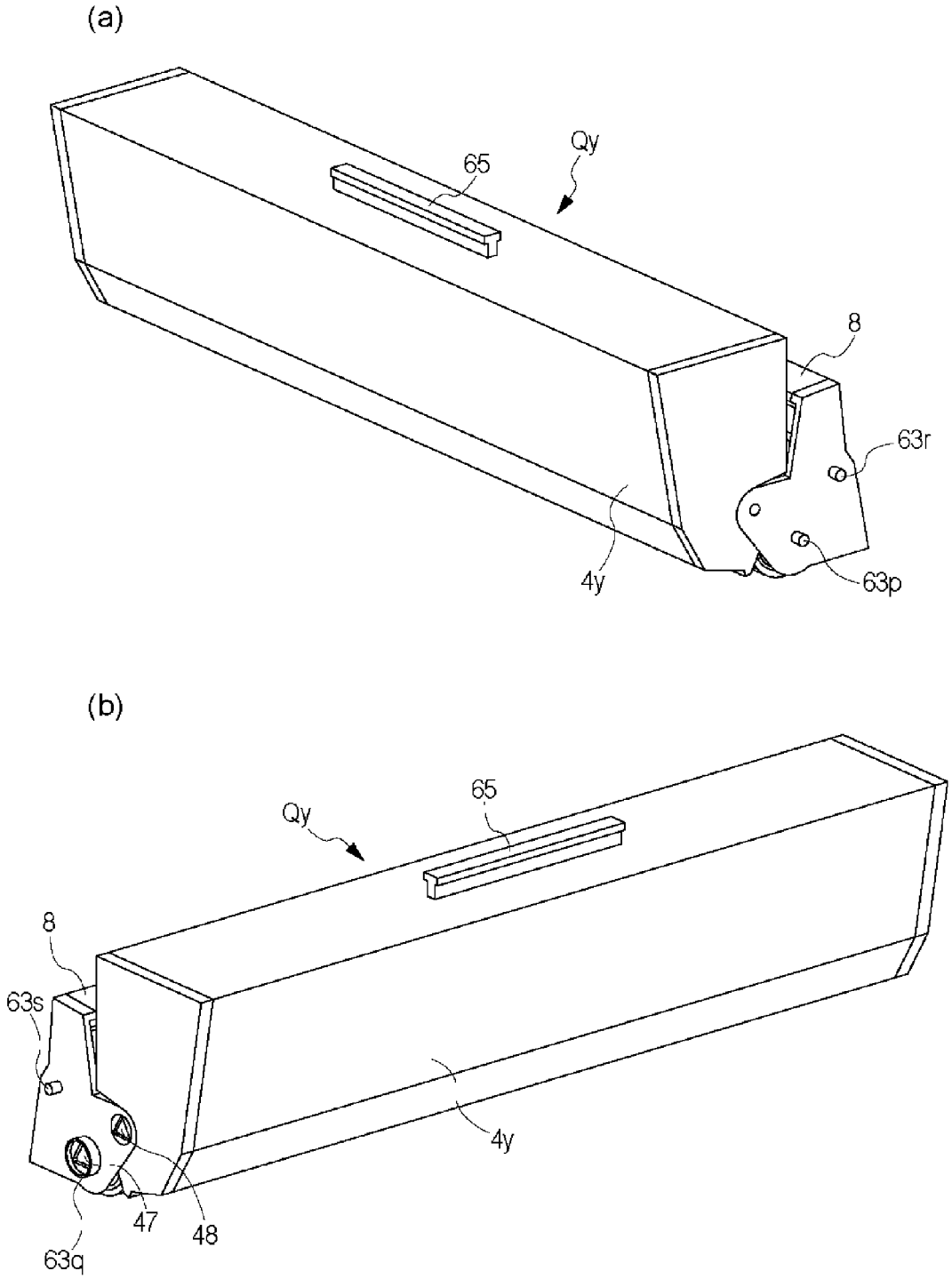
FIG. 18 is perspective views of the cartridge Qy as seen from the top-left (a) and top-right (b) sides, respectively, of the cartridge Qy.

Next, referring to FIGS. 12(*b*) and 18, the cartridge Q, which is to be installed into (supported by) the cartridge drawer 70 is described. Here, the cartridge Qy shown in FIG. 18, which is an external perspective view of the cartridge Qy, is described as a representative of the cartridges Qy, Qm, Qc and Qd, which are the same in structure although they are different in the color of the developer they store. The various structural components of the cartridge Q are the same as those of the cartridge P in the first embodiment.

(Installation of Cartridge into Cartridge Drawer)

Figure 14:
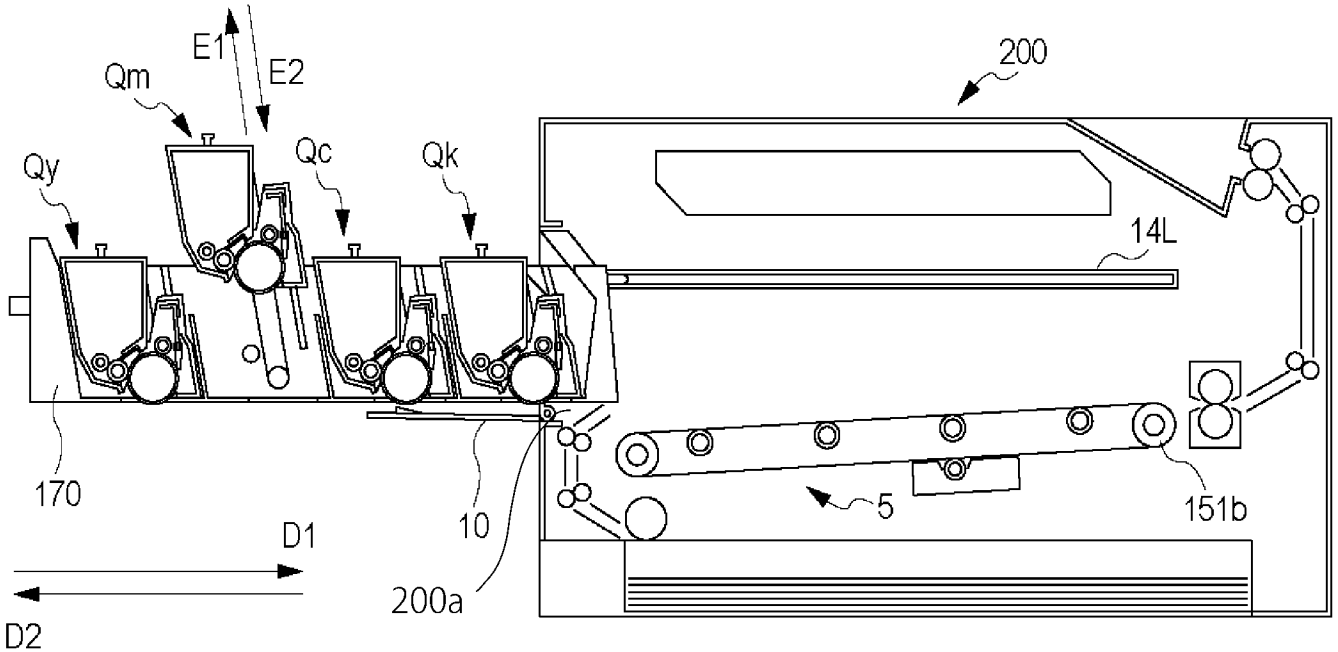
FIG. 14 is a schematic vertical sectional view of the image forming apparatus 200 at a vertical plane perpendicular to the front panel of the apparatus 100, as seen from the right-hand side of the apparatus 200, when the cartridge drawer of the apparatus 200 is in its preset outside position.
Figure 19:
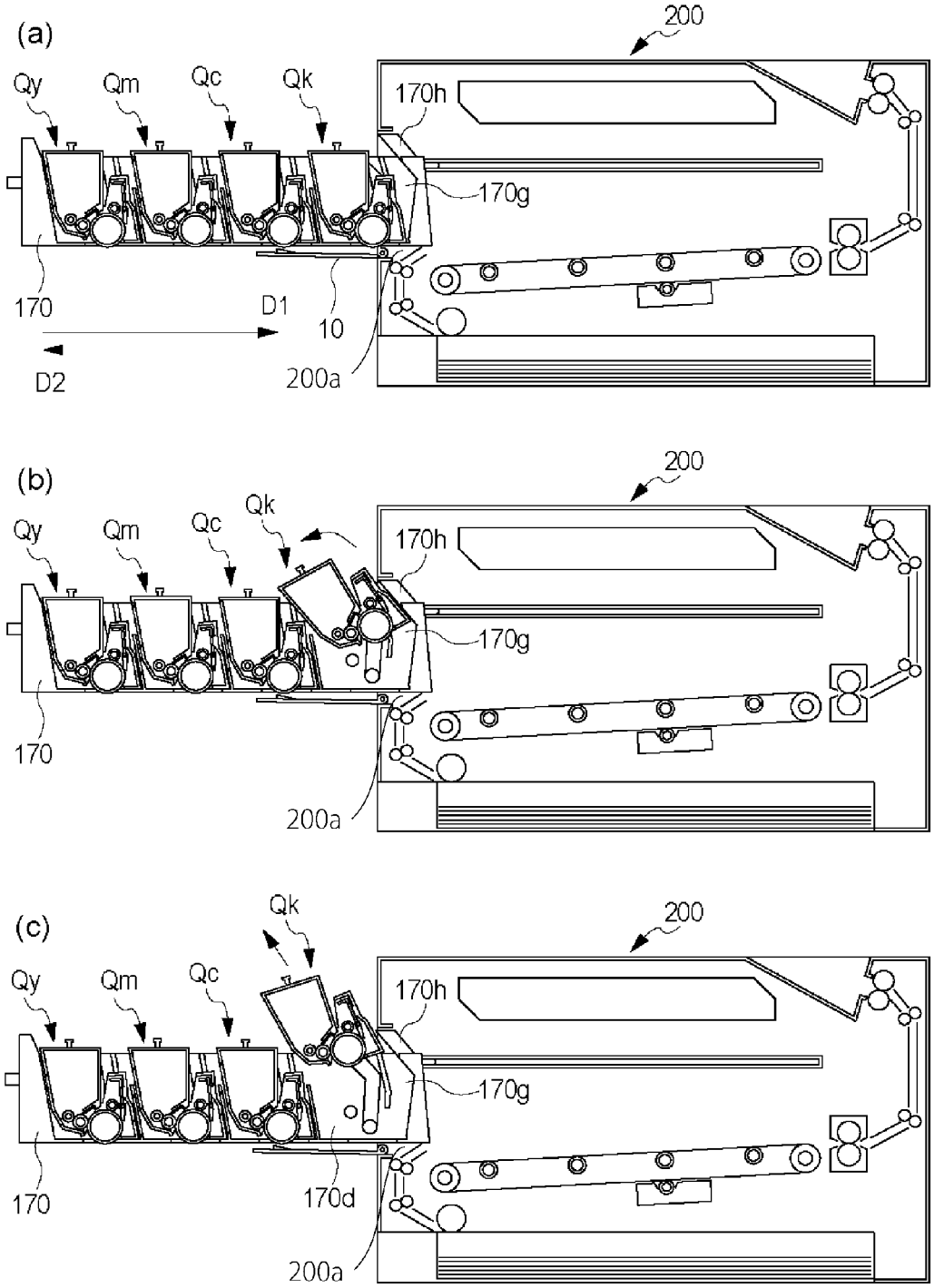
FIGS. 19(*a*), 19(*b*) and 19(*c*) are schematic vertical sectional views of the image forming apparatus 200, at a vertical plane parallel to the moving direction of the cartridge drawer of the image forming apparatus 200, and shows the sequential steps for removing the cartridge Qk from the main assembly of the image forming apparatus 200.

Next, referring to FIGS. 14, and 19(*a*)-19(*c*), the method for installing the cartridges Q (Qy, Qm, Qc and Qk) into the cartridge drawer 170 is described. FIG. 14 is a schematic vertical sectional view of the image forming apparatus 200 at a vertical plane perpendicular to the front panel of the apparatus 200, as seen from the right-hand side of the apparatus 200, when the cartridge drawer 170 of the apparatus 200 is in its preset outside position and the cartridge Qm is being taken out of the drawer 170. FIGS. 19(*a*), 19(*b*), and 19(*c*) are schematic vertical sectional views of the image forming apparatus 200, at a vertical plane parallel to the moving direction of the cartridge drawer of the image forming apparatus 200, and show the sequential steps for removing the rearmost cartridge Qk from the cartridge drawer 170 (main assembly of image forming apparatus 200).

All of FIGS. 14 and 19 show the state of the image forming apparatus 200, in which the cartridge drawer 170 is in a preset outside position. When the drawer 170 is in the preset outside position, the cartridge Qk, which is in the most upstream cartridge slot in the drawer 170 in terms of the direction D2 (outward direction) is partially within the apparatus main assembly 200A; a part of the photosensitive member unit 8 is within the apparatus main assembly 200A. If the cartridge Qk is moved in the direction E2 like the cartridges Qy, Qm and Qc, the apparatus main assembly 200A interferes with the movement of the cartridge Qk, preventing thereby the cartridge Qk from being taken out.

In this embodiment, however, the guide 175*d* is shaped as described above. Therefore, the cartridge Qk can be taken out of the cartridge drawer 170 through the following operation. That is, first, a user is to pull the cartridge drawer 170 out of the apparatus main assembly 200A, to the preset outside position as shown in FIG. 19(*a*). Then, the user is to grasp the hand-hold 65 of the cartridge Qk and pull the cartridge Qk upward. As the user pulls upward the cartridge Qk, the cartridge Qk is guided by the guides 175*d*1-175*d*4 with which the guides 63*p*-63*s* are in engagement. Therefore, the cartridge Qk moves upward while shifting rearward (direction E3). As the cartridge Qk moves upward while shifting rearward, a part of the cartridge Qk (part of photosensitive drum unit 8) enters the recess 170*g* of the cartridge drawer 170.

As the cartridge Qk is lifted further, the guides 175*d*3 and 175*d*4, with which the guides 63*r* and 63*s* are engaged, change in direction. Thus, the cartridge Qk begins to move upward while rotating in the counterclockwise direction as shown in FIG. 19(*b*). At this point in time, a part of the cartridge Qk is already in the recess 170*g*, which is provided as the space for the cartridge Qk to be allowed to rotate. FIG. 19(*b*) shows the state of the image forming apparatus 200 in which the cartridge Qk has just ended its rotation guided by the guides 175*d*1-175*d*4. At this point in time, the guides 63*r* and 63*s* disengage from the guides 175*d*3 and 175*d*4, respectively. The image forming apparatus 200 is structured so that when it is in its state shown in FIG. 19(*b*), the regulation section 170*h* is parallel and close to the cartridge Qk (rear surface of photosensitive unit 8). That is, the guides 175*d*3 and 175*d*4 are structured so that the distance by which the cartridge Qk is moved in the direction D2 (outward direction) when it is taken out of the cartridge slot 170*d* is greater than the distance by which the other cartridges Qy, Qm and Qc are moved in the direction D2 (outward direction) when they are taken out of their slots 170*a*, 170*b* and 170*c*, respectively.

Then, the guides 63*p* and 63*q* of the cartridge Qk engage with the guides 175*d*1 and 175*d*2, and therefore, the cartridge Qk is guided by the guides 175*d*1 and 175*d*2. Further, the rear surface of the photosensitive member unit 8 comes into contact with the regulation section 170*h*. Therefore, the cartridge Qk is moved diagonally upward while being prevented from rotating. That is, the regulation section 170*h* prevents the cartridge Qk from coming into contact with the edges of the opening 100 of the apparatus main assembly 200A, and their adjacencies. Therefore, the cartridge Qk can be smoothly taken out of the cartridge drawer 170.

As described above, the point at which the guides 63*p* and 63*q* disengage from the guides 175*d*1 and 175*d*2, respectively, is on the front side of the point at which the guides 63*p* and 63*q* would disengage from the guides 175*d*1 and 175*d*2, respectively, if the guide 175*d* were the same in shape as the guides 175*a*-175*c*.

The greater the distance by which the cartridge drawer of an image forming apparatus is pulled out, the more unbalanced in weight distribution is the apparatus, making it possible for the apparatus to tilt. Thus, in this embodiment, the image forming apparatus 200 is structured so that the distance by which its cartridge drawer can be pulled out is made substantially less than the distance by which the cartridge drawer of the image forming apparatus 100 in the first embodiment can be pulled out. However, the image forming apparatus 200 is structured as described above. Therefore, it allows the cartridge for the most upstream cartridge slot of its cartridge drawer to be installed in the drawer at a more frontword point.

In order to lift a cartridge diagonally frontward by changing its moving direction by rotating the cartridge as the cartridge Qk is, a space is necessary in the rear portion of the cartridge slot. If the guides of all of the four cartridge slots 170*a*-170*d* are structured like the guide 175*d*, the cartridge drawer may have to be increased in size, which may result in an increase in the size of an image forming apparatus. However, the space behind the rear end portion of the cartridge drawer 170, that is, the rear side of the most upstream cartridge slot 170*d* in terms of the direction D2 (outward direction) is a part of the space in which the drawer 170 moves. Therefore, it is a dead space when the drawer 170 is in the preset outside position. Therefore, utilizing this space to allow the most upstream cartridge Qk to rotate does not result in an increase in the size of the drawer 170 and/or image forming apparatus 200. In a case where the cartridge drawer 170 is reduced in size by using a sheet of metallic plate as the material for the drawer 170, it is possible to provide the rear wall of the cartridge drawer 170 with an opening in a preset position so that the opening functions like the recess 170*g*. This is why it is desired that only the most upstream cartridge slot 170*d*, in terms of the outward direction of the drawer 170, and its guide 175*d*, are structured as described above.

In the above, the cartridge Q removably installable in the cartridge drawer 170 was described as a process cartridge. However, the cartridge Q may be a development cartridge. That is, the cartridge drawer 170 may be provided with guides for removably installing a development cartridge for developing an electrostatic latent image on a photosensitive drum, in the drawer 170.

In this embodiment, the guides of only the most upstream cartridge slot, in terms of the outward direction of the cartridge drawer were given a section which is more tilted downstream in terms of the outward direction of the drawer than the guides of the other cartridge slots of the drawer. However, the guides of the other cartridge slots also may be provided with a section which is substantially more tilted downstream than the guides of the downstream cartridge slots in terms of the outward direction of the cartridge drawer.

(Summary)

By structuring the guides of the most upstream cartridge slot in terms of the outward direction of the cartridge drawer as in the first and second embodiments, it is possible to start guiding a cartridge from a point substantially closer to the front side of an image forming apparatus than the point at which it is possible to start guiding a cartridge in the case of any image forming apparatus in accordance with the prior art, during cartridge installation, and also, to guide a cartridge to a point substantially closer to the front side of an image forming apparatus than in the case of any image forming apparatus in accordance with the prior art, during cartridge uninstallation. Therefore, it is possible to improve an image forming apparatus in operability in terms of the installation and uninstallation of a cartridge for the most upstream cartridge slot in terms of the outward direction of the cartridge drawer, and also, to make it unlikely for a cartridge, and the processing members of the cartridge, to be damaged during the installation and uninstallation of the cartridge.

According to the present invention, it is possible to provide an image forming apparatus which is superior in operability than any image forming apparatus in accordance with the prior art, in terms of the installation of a cartridge into the cartridge drawer of the apparatus, and the uninstallation of a cartridge from the cartridge drawer of the apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 110619/2011 filed May 17, 2011 which is hereby incorporated by reference.

What is claimed is:

1. An image forming apparatus for forming an image on a recording material, said image forming apparatus comprising:

a cartridge supporting member movable between an inside position in which said cartridge supporting member is inside a main assembly of said image forming apparatus in a state of carrying a first cartridge and a second cartridge, and a drawn position in which said cartridge supporting member is outside said main assembly of said apparatus and in which said first cartridge and said second cartridge are mountable and demountable relative to said cartridge supporting member, wherein said cartridge supporting member includes a first mounting portion to which said first cartridge is mountable, and a second mounting portion to which said second cartridge is mountable, said second mounting portion being disposed upstream of said first mounting portion with respect to a drawing direction in which said cartridge supporting member is moved from the inside position to the drawn position;

a first guide portion, provided on said cartridge supporting member, for guiding mounting and demounting of said first cartridge relative to said first mounting portion; and a second guide portion, provided on said cartridge supporting member, for guiding mounting and demounting of said second cartridge relative to said second mounting portion, wherein when said second cartridge is dismounted from said second mounting portion, said second cartridge moves in a downstream direction with respect to the drawing direction, and wherein a distance of movement, in the downstream direction, of said second cartridge along said second guide portion from said second mounting portion until said second cartridge is dismounted is greater than a distance of movement, in the downstream direction, of said first cartridge along said first guide portion from said first mounting portion until said first cartridge is dismounted.

2. An apparatus according to claim 1, wherein said second guide portion has a guiding portion which is inclined toward the downstream direction more than a guiding portion of said first guide portion.

3. An apparatus according to claim 2, wherein said inclined guiding portion is disposed in a downstream side of a dismounting direction in which said second cartridge is dismounted from said second mounting portion.

4. An apparatus according to claim 1, wherein said first guide portion includes a guiding portion which is inclined toward the downstream direction with respect to the drawing direction, and said second guide portion is provided with a guiding portion which is inclined toward the downstream direction with respect to the drawing direction more than said guiding portion of said first guide portion.

5. An apparatus according to claim 1, wherein said first guide portion includes a groove engageable with a projection provided on said first cartridge.

6. An apparatus according to claim 1, wherein said second mounting portion is disposed in an uppermost-stream position with respect to the drawing direction, among said mounting portions, and wherein said cartridge supporting member is provided with a regulating portion for regulating an attitude of said second cartridge by contacting said second cartridge to prevent said second cartridge from contacting said main assembly of said apparatus when said second cartridge is dismounted from said main assembly of said apparatus.

7. An apparatus according to claim 6, wherein when said second cartridge is mounted to said second mounting portion, a part of said second cartridge is inside said main assembly of said apparatus when said cartridge supporting member is in the drawn position.

8. An apparatus according to claim 6, wherein said regulating portion is disposed upstream of said second guide portion with respect to the drawing direction.

9. An apparatus according to claim 8, wherein said regulating portion is inclined downstream with respect to the drawing direction.

10. An apparatus according to claim 1, wherein said cartridge includes three of said first mounting portions and one of said second mounting portion.

11. An apparatus according to claim 1, wherein said cartridge supporting member carries said first cartridge and said second cartridge, and said first cartridge is provided with a first grip portion to be used when said first cartridge is dismounted from said mounting portion, and said second cartridge is provided with a second grip portion to be used when said second cartridge is dismounted from said mounting portion, and wherein said second grip portion is inclined more toward the downstream direction than said first grip portion.

12. An apparatus according to claim 11, wherein each of said first cartridge and said second cartridge includes a photosensitive member and developing means for developing an electrostatic latent image formed on said photosensitive member.

13. An apparatus according to claim 11, wherein said first cartridge and said second cartridge are developing cartridges for developing electrostatic latent images formed on photosensitive members.

14. An apparatus according to claim 1, further comprising transferring means for transferring toner images from a plurality of photosensitive members provided on said cartridge supporting member when said cartridge supporting member is in the inside position.

15. An apparatus according to claim 1, further comprising feeding means for feeding a recording material onto which a toner image from a plurality of photosensitive members provided on said cartridge supporting member when said cartridge supporting member is in the inside position.

16. An apparatus according to claim 1, wherein said first cartridge does not move in the downstream direction throughout a duration in which said first cartridge is moved along said first guide portion from said first mounting portion until said first cartridge is dismounted.

17. A cartridge supporting member movable between an inside position inside a main assembly of an image forming apparatus in a state of carrying a first cartridge and a second cartridge, and a drawn position which is outside the main assembly of the image forming apparatus and in which the first cartridge and the second cartridge are mountable and demountable, comprising:

a first mounting portion to which the first cartridge is mountable, and a second mounting portion to which the second cartridge is mountable, with said second mounting portion being disposed upstream of said first mounting portion with respect to a drawing direction in which said cartridge supporting member is moved from the inside position to the drawn position;

a first guide portion, provided within said first mounting portion, for guiding mounting and demounting of the first cartridge relative to said first mounting portion; and a second guide portion, provided within said second mounting portion, for guiding mounting and demounting of the second cartridge relative to said second mounting portion, wherein when the second cartridge is dismounted from said second mounting portion, said second guide portion guides the second cartridge in a downstream direction with respect to the drawing direction, and wherein a distance of movement, in the downstream direction, of the second cartridge along said second guide portion from said second mounting portion until the second cartridge is dismounted is greater than a distance of movement, in the downstream direction, of the first cartridge along said first guide portion from said first mounting portion until the first cartridge is dismounted.

18. A member according to claim 17, wherein said second guide portion has a guiding portion with a lower section which is inclined toward an upstream direction of the drawing direction and an upper section which is inclined toward the downstream direction.

19. A member according to claim 17, wherein said first guide portion includes a guiding portion which is inclined toward the downstream direction with respect to the drawing direction, and said second guide portion is provided with a guiding portion which is inclined toward the downstream direction with respect to the drawing direction more than said guiding portion of said first guide portion.

20. A member according to claim 17, wherein said first guide portion includes a groove engageable with a projection provided on the first cartridge.

* * * * *